US006669600B2

(12) United States Patent
Warner

(10) Patent No.: US 6,669,600 B2
(45) Date of Patent: Dec. 30, 2003

(54) COMPUTERIZED REPETITIVE-MOTION EXERCISE LOGGER AND GUIDE SYSTEM

(76) Inventor: Richard D. Warner, 749 S. Lemay, Box A3-178, Fort Collins, CO (US) 80524

( * ) Notice: Subject to any disclaimer, the term of this patent is extended or adjusted under 35 U.S.C. 154(b) by 0 days.

(21) Appl. No.: 09/752,540

(22) Filed: Dec. 29, 2000

(65) Prior Publication Data

US 2002/0086774 A1 Jul. 4, 2002

(51) Int. Cl.[7] ..... A63B 21/00
(52) U.S. Cl. ..... 482/8; 482/4
(58) Field of Search ..... 482/1–9, 51, 900–902

(56) References Cited

U.S. PATENT DOCUMENTS 4,144,568 A 3/1979 Hiller et al.
4,283,712 A 8/1981 Goody
4,320,895 A 3/1982 Muller
4,334,190 A 6/1982 Sochaczevski
4,408,183 A 10/1983 Wills
4,571,698 A 2/1986 Armstrong
4,780,085 A 10/1988 Malone
4,817,940 A 4/1989 Shaw et al.
4,823,367 A 4/1989 Kreutzfeld
4,828,257 A 5/1989 Dyer et al.
4,867,442 A 9/1989 Matthews
4,907,795 A 3/1990 Shaw et al.
5,196,846 A 3/1993 Brockelsby et al.
5,245,162 A 9/1993 Takahashi
5,245,346 A 9/1993 Nishimura et al.
5,436,611 A 7/1995 Arlinghaus, Jr.
5,478,295 A 12/1995 Fracchia
5,490,816 A 2/1996 Sakumoto
5,511,045 A 4/1996 Sasaki et al.
5,516,334 A 5/1996 Easton
5,538,007 A 7/1996 Gorman
5,737,280 A 4/1998 Kokubo
5,749,372 A 5/1998 Allen et al.
5,762,584 A 6/1998 Daniels
5,857,939 A 1/1999 Kaufman
5,890,997 A 4/1999 Roth
5,897,457 A 4/1999 Mackovjak
5,921,891 A 7/1999 Browne
5,947,869 A 9/1999 Shea
6,027,429 A 2/2000 Daniels
6,050,924 A 4/2000 Shea
6,122,960 A 9/2000 Hutchings et al.
6,146,313 A 11/2000 Whan-Tong et al.
6,458,060 B1 * 10/2002 Watterson et al. ..... 482/54
6,475,115 B1 * 11/2002 Candito et al. ..... 482/4

* cited by examiner

*Primary Examiner*—Glenn E. Richman

(57) ABSTRACT

This system includes a self-contained, non-invasive system for collecting work and power performance data on nearly any kind of repetitive-motion exercise. See the glossary for definitions of terms used in this specification. It is non-invasive in that no permanent modifications need made to existing exercise equipment. It is a battery-powered system that remotely senses iterations of a moving part or body member, and records them with a time-stamp. It also records weight and distance of travel if they are input—but for some exercises this function may be deemed not necessary, or ignored.

If time, weight, and distance are known then work and power metrics can be calculated on the data when it is analyzed on a host computer. This data can then be graphed to provide comparisons from workout session to workout session. The user can detect trends, and differences in performance as workout variables are manipulated. Workout variables include, but are not limited to: weight, distance of travel, time, order of exercise stations, number of sets, number of repetitions per set, pattern of weight increase/decrease for a given exercise station over the sets, pattern of extension and contraction per repetition, etc.

20 Claims, 13 Drawing Sheets

COMPUTERIZED REPETITIVE-MOTION EXERCISE LOGGER AND GUIDE SYSTEM

CROSS-REFERENCES TO RELATED APPLICATIONS

None. No provisional application was filed.

BACKGROUND

1. Field of Invention

This invention relates to collecting athletic performance data, specifically to an improved logging and pacing system that generically works with most exercises.

2. Description of Prior Art

Prior to this invention it has been difficult to collect performance data of one's exercise regime without an extra person and tedious manual record-keeping. It is desirable to be able to quantify one's power and ability to do work, and monitor trends over time. This can be manually accomplished by a person with a clipboard writing down weights, and distances for each set plus times for each repetition in the set of a given weight routine. The trainer must then type it all into a computer and graph or analyze it there. For running, a person or persons with stop-watches is required. It is desirable to be able to represent such data visually in graphs in calculated units of work and power for individual exercise stations or for the entire workout session, but without all the manual work and tedium. It is desirable to have a simple, inexpensive approach that will generically work with most types of exercises.

Another important aspect has to do with improving one's ability to do work (used as a term of physics). It is desirable to design different exercise routines (different combinations and sequences of exercise stations) and compare the ability to do work using these different configurations. Some "traditional" techniques may under close scrutiny be determined to be ineffective or not optimally effective for a given individual.

For example, one may design an exercise routine that starts with working three exercise stations for upper-body development, and then do three exercise stations specifically for the back. The next day one may do three exercise stations for the abdomen and three exercise stations for the legs. Collect work and power metrics for all the exercise stations. Optionally, total metrics for the two workouts could be calculated. Next, one can modify this workout design so that the first day does three stations for the back and then three for the upper-body (reverse the order). Likewise, for the second day the order is reversed. How do the performance metrics differ? A change in order like this may significantly increase individual performance (as indicated by work and power statistics).

Another example would be to change the number of sets or repetitions or amount of weight for each set to help identify optimal configurations. Or monitor trends over a period of months for established routines. Or refine tapering techniques so that maximal power is available for a crucial competitive event. Currently even the most disciplined record-keeping athletes must largely depend on subjective opinion as to what constitutes their best workout regiment, because they do not do the math and it takes a lot of time to create useful graphs of data. The time would be spent in the record-keeping, and data entry, rather than in the design of better workouts.

It is true the individual athletes can collect some of this data manually themselves, by writing down numbers after a weight-lifting set, or recording a time from a stop-watch a runner carries. This detracts from the athletes concentration and has the same limitations for analysis of requiring mathematics performed to compute work and power metrics, and requiring manual input into a computer. Thus the typical current process supports the analysis of an individual athlete's performance typically only with gross granularity.

A number of computerized, automating approaches have been suggested. Many approaches use transmitters and receivers, such as U.S. Pat. No. 5,511,045 to Sasaki, Apr. 3, 1996 or U.S. Pat. No. 5,737,280 to Kokubo, Apr. 7, 1998. This approach has limited flexibility and is complicated to implement. Typically a network of transmitters or terminals must exist (complicated) and it is hard to apply the approach generically to any given exercise station (less flexible)—the designs tend to be specific for one task, such as running.

None of the approaches embed small, simple, cheap, magnets along the running track to work with the same generic logging system that is used for other types of exercise stations.

Many approaches require integrating circuitry into the exercise equipment, such as U.S. Pat. No. 6,027,429 to Daniels on Feb. 22, 2000 which provides resistive force feedback to the user. This approach also limits flexibility because the exercise equipment must be modified.

U.S. Pat. No. 6,050,924 to Shea on Apr. 18, 2000 uses a network of terminals to provide information to a user about previous workouts. Once again, this limits flexibility because the device takes time to setup the network or make changes to it, plus it is more complicated and more expensive than having one unit that moves from station-to-station with you.

Another approach, taken by U.S. Pat. No. 5,947,869 to Shea Sep. 7, 1999 allows for a computerized exercise station to accept customized programs for an individual, but once again this approach only works with exercise equipment especially designed for it (limited flexibility).

Heartbeat, respiration, and other physiological data are collected in other approaches such as by U.S. Pat. No. 4,867,442 to Matthews on Sep. 19, 1989 but this does not focus on work and power metrics of the individual in a generic way. The focus here is on the biological stress to the human body, rather than the quantity of external work and power manifested by the body. The additional wires and sensors attaching to the athlete may be a distraction.

In general, the requirements for collecting work and power data for generic exercise repetitions had not currently been met. This requires a stand-alone unit with a sensitive sensor for detecting repetitions at several feet distance, plus a clock mechanism for recording time-stamps. The data must easily be uploaded to a host computer for analysis.

Numerous approaches to pacing systems also exist. Typically these are not dynamic. They set a pace for the user based on a time clock, and do not include input from the user. For example, an audio tone may be generated every three seconds, but the device does not know when the user has completed the desired repetitions. The device cannot tell the user he/she needs to speed up or slow down.

Or, they may have input from the user, such as U.S. Pat. No. 5,490,816 to Sakumoto on Feb. 13, 1996 or U.S. Pat. No. 4,334,190 to Sochaczevski on Jan. 8, 1982 These are based on the approximated length of stride, rather than absolute marked distances such as segments around a running track (the latter patent also uses an inertial mechanical sensor rather than an electronic one). Greater accuracy is obtained by using the absolute marked distances.

Some approaches use a sensor to dynamically collect data, but they require additional devices to interface to the exercise equipment. An example of this would be U.S. Pat. No. 4,780,085 to Malone Oct. 25, 1988 It is used only for swimming, and required a special diving platform to trigger the start of its sensor input. Once again, a generic approach should not require special adapters or modifications to the exercise equipment.

Another limitation of many existing sensor approaches is their range. Many use sensors that have a range of a few inches or less (such as reed switches). To generically handle exercise stations one needs a sensor range of several feet.

Other approaches add features that substantially increase cost and complexity but add little or nothing to the collection of the basic work and power performance data. For example, U.S. Pat. No. 5,857,939 by Kaufman on Jan. 12, 1999 records a count of iterations based on spoken words. This requires a lot of memory, and expensive voice-recognition circuitry, when a modest sensor circuit will do the same thing.

The computerized performance monitor of U.S. Pat. No. 4,907,795 to Shaw, et al on Apr. 4, 1989 requires electro-mechanical modifications to a given exercise station to support the use of its infrared sensing system. This limits flexibility once again, and is not a generic approach. It appears to only work with variable-resistance exercise stations that use a chain drive and have been properly modified for use with their device, and it is intended that a separate monitoring screen is placed at each exercise station.

Further, the claims state that it has a removable memory module. Thus, a special device is needed by the host computer to read the contents of the memory module as opposed to merely using a communication cable to read the contents of EEPROM. That approach adds complexity and cost. Further, the claims indicate it keeps data from previous sessions in the device itself so that real-time comparisons can be made during an exercise session and the proposed system does not do this. It is better not to distract the athlete and do all the analysis and comparisons on the host computer.

The claims indicate the current and past performance is analyzed by the device based on percentage difference rather than absolute values. This is a different emphasis from looking at absolute values so as to be able to compare one athlete with another. This system is not a stand-alone, mobile unit, for collecting work and power performance data without making permanent modifications to existing exercise equipment.

SUMMARY

The present invention is a computerized, mobile, non-invasive, exercise logging and pacing system. It is non-invasive in the sense that no permanent modifications are needed to a given piece of exercise equipment in order for it to work with the system. It is comprised of a sensor, internal memory, software that controls the entire device and provides logging and pacing logic, a communication interface to a host computer, a display, a keypad or other input device, a controller module, audio and optionally visual cueing devices, and a power supply.

Glossary

Module: A manufactured combination of parts that can be embedded inside another product.

Subsystem: A combination of components that must be manufactured or assembled as part of the product manufacturing process. The subsystem represents a logically-unified function.

Exercise Station: Location and configuration for performing a specific exercise. An exercise station may contain exercise equipment, such as non-integrated equipment, and supporting equipment such as safety mats. The station may merely be a location for exercises that depend on movement of a body alone, such as push-ups, or kicks, or jogging.

Variable-Resistance Exercise Station: Exercise station upon which a set of specific weight-lifting exercises are possible. The weight is variable and selectable, based upon the number of weighted bars selected. The weighted bars typically move vertically via cable or chain in response to user motion. Numerous station designs support a wide variety of exercises.

Flexible Variable-Resistance Exercise Station: Elastic bands or flexible rods are used to provide resistance. The amount of resistance is typically variable and/or selectable based on the number of bands or rods that are selected.

Repetitive-Motion Exercise: Includes but is not limited to, lap running, dips, boxing, exercise performed on variable-resistance exercise stations or flexible variable-resistance exercise stations or other types of exercise stations, lap swimming, lap running, etc. Any body movement of a cyclic or repetitive nature.

Non-Integrated Equipment: Exercise equipment that is separate, or not permanently attached to the system providing computerization. Exercise equipment not already computerized, plus the human body itself.

Objects and Advantages

This system greatly improves upon manual record-keeping. The system records all repetitions automatically, but does require input of weight and distance of travel (however, some sensing approaches will determine distance of travel too). Additionally it provides a time-stamp for each repetition which currently is not done in a manual process. It can record multiple workout sessions between uploads to a host computer. Uploading to a host computer and graphing of the data can be done simply and quickly. It saves the user from the tedium of typing that data into a host computer for graphing and analysis, and thus makes it more likely that a given athlete will perform graphical analysis of the data. This will give him/her greater insight into how to improve their workout efficacy.

For instance, one theory is that if a person can maintain an optimum power and work balance throughout a workout session, that they will have optimum performance gains. Put another way, the theory is that it is better to do high work with high power rather than maximal work with moderate power (where the work is at peak weight levels, but done slowly). A system such as this will help a user identify their zone of optimum power and work (where they are moving substantial weight a substantial distance and at a substantial rate).

It will help them design a workout by allowing them to manipulating workout variables and then graphically see the impact of their manipulations. Workout variables include such things as: weight, distance of travel, time, order in which exercise stations are visited, number of sets, number of repetitions per set, etc. Their goal may be to manipulate these variables so as to maintain such an optimal zone throughout the entire workout session.

No transmitters or receivers need be permanently installed on the exercise equipment. It is possible that an active component of a given sensing means, or motion sensor, would need to be temporarily affixed to a given piece of exercise equipment. In the case of a running track, magnets would permanently be embedded at set locations along the track, but the magnets do not need power lines or communication lines attached to them and they are far simpler than a transmitter or receiver. No network of devices is necessary. No individual display is necessary at each exercise station is necessary. No permanent modification of an exercise station is necessary. There are no external wires to tangle or present safety hazards. The system can be moved from one exercise station to another and requires a very brief setup time. The system at most requires the placement of a small magnet (if a magnetic sensor is used) on the moving part or body member. The system, as currently embodied using the magnetoresistive sensor has an effective range up to approximately ten feet. Numerous factors tend to reduce this range in practice, but it still has a range of several feet. This is required to handle diverse configurations of equipment. The system has high precision timing accuracy by using a separate clock module. The system is able to differentiate between the moving part or body member to be monitored, and any surrounding equipment or members.

All these features work together to provide a tremendous degree of generic use. It allows the system to work with free-weights, or variable-resistance equipment or flexible-rod/band resistance equipment, or for exercises that require no additional equipment at all. Exercises such as push-ups, or sit-ups, or lap running, or lap swimming can be monitored with this system. The system can log exercises on stationary frames, such as dips. Most repetitive-motion exercises can be logged or paced using this system.

The system records repetitions automatically, and other data can be input quickly with a few button presses. The user can do analysis work quickly after the workout is completed, so as not to detract from the user's concentration while exercising.

This system focuses on collecting performance metrics relating to work and power that an individual can manifest. For athletes, that is typically their main focus. They tend to care about the end result—their ability to do high levels of work with high levels of power. Its emphasis is not on monitoring the biological stress of the individual (such as would be seen through heart, respiration, temperature, and other related metrics).

The system can pace an athlete's workout dynamically. A trainer, or coach, or the user themselves, can provide a pre-programmed exercise routine. Based on the pre-programmed routine the system knows how many repetitions the user is supposed to do before a given set is completed. Based on the sensor input, the system knows when the set is completed. The system can tell the user to go slower or faster based on the sensor input too.

This pacing applies to virtually any of the exercise stations the system will work at, but it may have different embodiments. Pacing can be provided on the running track (see FIG. 4), such as by the system beeping five times and the runner knowing he/she must be over the next embedded magnet by the end of the fifth beep. Note that the pacing is based upon absolute distances on the track, rather than approximations of stride length. Attachments such as a special diving platform (for swimming) or a horizontal rod (for running) to mark the beginning, are not used. Instead, a button is provided for marking the start and stop.

Pacing in the weight room (see FIGS. 2 and 3) typically would be tones. The system can indicate a too slow or too fast pace, or the end of a set, or the beginning or end of a rest period, or when it is time to go to the next exercise station.

Techniques that add complexity and cost but little functionality have been avoided, such as by logging repetitions based on verbal counting. Mechanical sensing approaches have been avoided for improved reliability. Distractions to the athlete, such as graphical displays for the athlete to watch while exercising, real-time comparisons to previous performance, physiology sensors, and the like have been avoided.

Other aspects of this invention will appear from the following description and appended claims, reference being made to the accompanying drawings forming a part of this specification wherein like reference characters designate corresponding points in the several views.

BRIEF DESCRIPTION OF THE DRAWINGS

In the drawings, closely related figures have the same number but different alphabetic suffixes.

LIST OF REFERENCE NUMBERS

Figure 1:
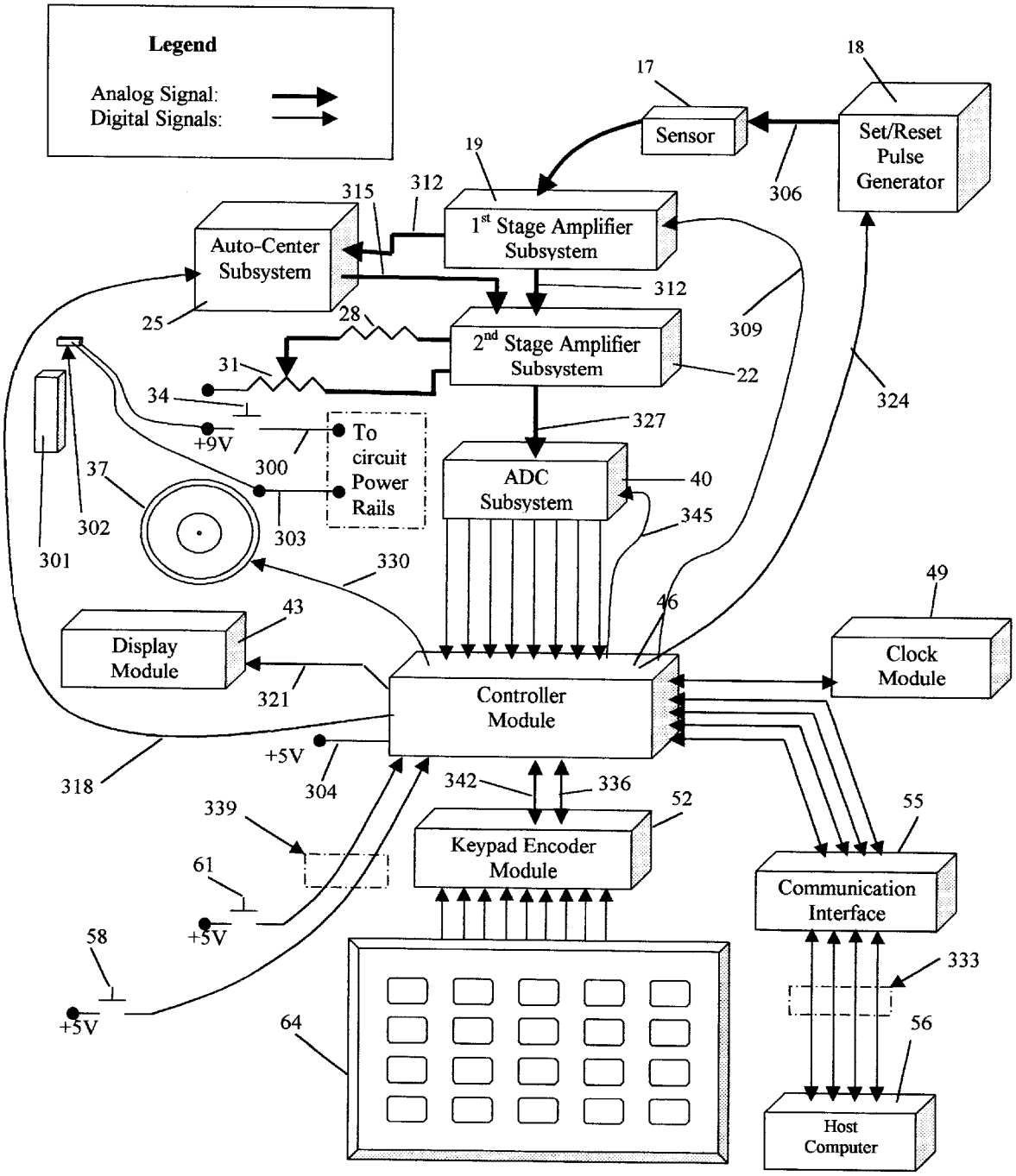
FIG. 1 is a block diagram showing logical units of the hardware.

17 Sensor
18 Set/Reset Pulse Generator
19 1st Stage Amplifier Subsystem
22 2nd Stage Amplifier Subsystem
25 Auto-Center Subsystem
28 Gain Resistor
31 Gain Potentiometer

34 On-Off Switch
37 Speaker
40 ADC Subsystem
43 Display Module
46 Controller Module
49 Clock Subsystem
52 Keypad Encoder
55 Communication Interface
56 Host Computer
58 Setup/Log Button
61 Start/Stop Button
64 Keypad
67 Free-Weight Dumb-Bell
70 Variable-Resistance Exercise Station
73 Small Magnet
76 Triggering Threshold
79 Portable Computerized System
82 Mathematical Set of Exercise Sets
88 Case
89 Stand Mount
90 Stand Mount
92 Mount Orifice
93 Join Line
94 Battery Compartment
97 Stand
100 Keypad
101 Keypad Pin Cutout
102 Display Bezel
103 Sensor Board
104 Display Cutout
105 Case Joiner
106 Bottom Board
107 Case Joiner
108 Bottom Case Joiner
109 Top Board
110 Top Case Joiner
111 Mounting Post
112 RJ-11 Communication Jack
113 Mounting Post
114 Keypad Pins
115 Voltage-Regulated Supply
116 Voltage-Regulated Supply Providing Negative Current
117 Communication Jack Cutout
119 Thumbwheel Cutout
120 Long Screw
121 HMC1001 Honeywell Magnetoresistive Sensor
122 Button Hole
123 Button Hole
124 Sensitivity Vector
125 Stand Bend
126 Keypad Cable Connector
127, 130 Screw Hole
128, 129 Guide Hole
142, 143, Screw Hole
146, 147
144, 145 Guide Hole
148 Male Connector
151 Integrated Switch Cutout
154 Speaker Magnet Cutout
157 Keypad Cutout
160 Ribbon Cable Connector
172 Trim Pot
173 Current-Limiting Resistor
175 Ribbon Cable Connector
181 Battery Connector Area
190 Button Connector Area
195 Female Connector
200 Set Header
203 Repetition Data
206 Set Trailer Record
209 Session Trailer Record
212 Fixed-Length Preprogrammed Exercise Routine Data
215 Process Next Set Block
218 End Of Session Decision Block
221 Return Control To Main Program
224 Interrupt Key Pressed Decision Block
227 Max Time Elapsed Decision Block
230 Rest Period Decision Block
233 Rest Period Processing
236 Configure System For Logging
239 Display Current Set Information To User
242 Initialize Pacing Program Variables
243 Write Set Trailer Block
245 Start Logging Decision Block
246 Start Button Processing
248 Set Completion Decision Block
251 Processing For Fast Repetition
254 Pacing Interval Decision Block
257 Repetition Detection Decision block
260 Repetition Detection Decision Block
263 Processing for Slow Repetition
266 Reset Pacing Interval Counter
300 Positive Nine Volts
301 Nine-Volt Battery
302 Battery Clip
303 Ground
304 Positive Five Volts
306 Set/Reset Pulse
309 Sleep
312 Low-Level Output Signal
315 Reference Signal
318 Auto-Center Control Signal
321 Display Serial Data
324 Set/Reset Control Signal
327 High-Level Output Signal
330 Audio Signal
333 Communication Signals
336 Keypad Serial Data
339 Button Signals
342 Keypad Buffer Signal
345 ADC Control Signal
400 Keypad Interface Logic Block
401 Setup/Log Interface Logic Block
402 Start/Stop Interface Logic Block
410 Logging Logic Block
420 Pacing Logic Block
421 Put System Into Regular Logging Mode
430 Initialization Logic Block
433 Main Loop
436 Input Weight Logic Block
439 Input Distance Logic Block
442 Menu Navigate Logic Block
445 Download Profile Data Logic Block
448 Upload Data Logic Block
451 Start Preprogrammed Exercise Routine Logic Block
454 Setup/Log Button Pressed Logic Block
457 Enter Logging Mode Logic Block
460 Start Mode Logic Block
500 Number/Data Button
503 Down Navigate/Station Button
506 Up Navigate/Statistics Button
509 Weight Button
512 Travel Button
515 Decrement Button

518 Increment Button
521 Enter Button
524 Program/Interrupt Button
527 Upload/Download Button
530 Zero/Options Button
533 Shift Button
536 Number/Reserved Button
600 Power Peak
604 Solid Gray
Partial Parts List (For Set/Reset Circuit)
R1 200 Ohm Resistor
R2 10K Ohm Resistor
R3 10K Ohm Resistor
C1 0.1 Micro-Farad Capacitor
C2 0.1 Micro-Farad Capacitor
C3 1.0 Micro-Farad Capacitor
C4 0.1 Micro-Farad Capacitor
Q1 FMMT717
Q2 FMMT617

Description of the Preferred Embodiment—Overview (FIG. 1, Software Pseudocode Listing)

As can be seen in FIG. 1, the controller module 46 is the core of the system. The controller module and its software program provide a controller means for coordinating interactions between several other logical groups of components. The particular controller module used in this embodiment is a Basic STAMP IIE produced by Parallax, Incorporated.

The controller module also contains an integrated memory which is comprised of an integrated data memory for storing logged data and an integrated routine memory for storing preprogrammed exercise routines and user profile data. This is provided by 16K of online EEPROM.

The company Parallax, Incorporated provides a development environment for their controller module. The development environment is used on a host computer to write the programs in a language called PBASIC. The programs are then downloaded to the controller module 46 via the communication interface 55. A built-in interpreter reads the tokenized program once it is stored in EEPROM. Application notes are available from the company describing how to build the communication interface and how to operate the development environment.

The software establishes a user interface for evaluating user input signals and generating output signals so that the user can interact with the system.

The user input is evaluated by the keypad interface logic block 400 and setup/log interface logic block 401 and start/stop interface logic block 402 (see software pseudocode listing).

The blocks listed in the preceding paragraph represent the highest-level blocks of specific software logic components that are contained within a general controlling logic infrastructure. The general controlling logic infrastructure is comprised of the other parts in the software pseudocode listing. The lower-level instructions that are called by the blocks of these three means are considered to be part of the higher-level blocks (the higher-level blocks are inclusive of the lower-level blocks).

The controller module also provides part of the communication interface for the preferred embodiment in that it has a built-in RS-232 line driver. A properly-wired communication jack is all that is required to complete the communication interface, as described in the documentation for the controller module. A communication interface is used to allow the system to communicate with a host computer.

One logical group of components provides a sensing means for creating a sensing signal based on the movement of a mechanical part on an exercise station or the movement of a body part. By sensing means, it is meant in effect, to be a motion sensor. The motion of an object of interest is detected by detecting when the object is within a certain proximity and when it is not. This preferred embodiment uses a sensing means based on a magnetoresistive sensor, the HMC1001 Honeywell magnetoresistive sensor 121. A small magnet is placed on the moving part or body member of interest, and when the part gets within a trigger threshold 76 (FIGS. 2,3) a sensing signal is generated.

The sensing means is comprised of the: sensor 17, set/reset pulse generator 18, $1^{st}$ stage amplifier subsystem 19, $2^{nd}$ stage amplifier subsystem 22, gain resistor 28, gain potentiometer 31, ADC subsystem 40, and an active component which in the preferred embodiment is a small magnet 73. Optionally a normalizing means comprised of the auto-center subsystem 25 is attached to the sensing means to filter out factors which may affect sensor performance.

Figure 11:
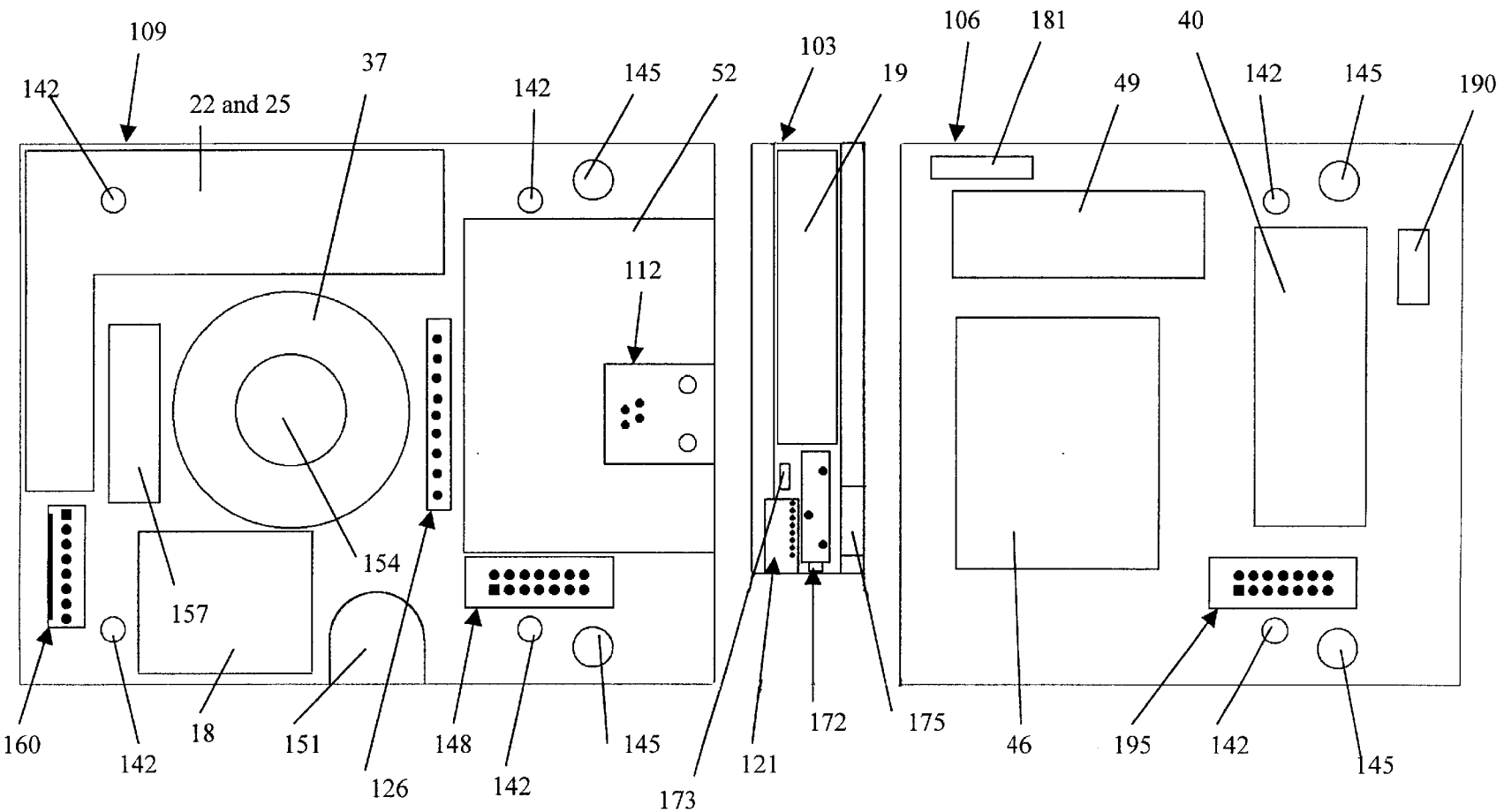
FIG. 11 is the silkscreen board layout of general parts, subsystems, and modules in one embodiment.
Figure 14:
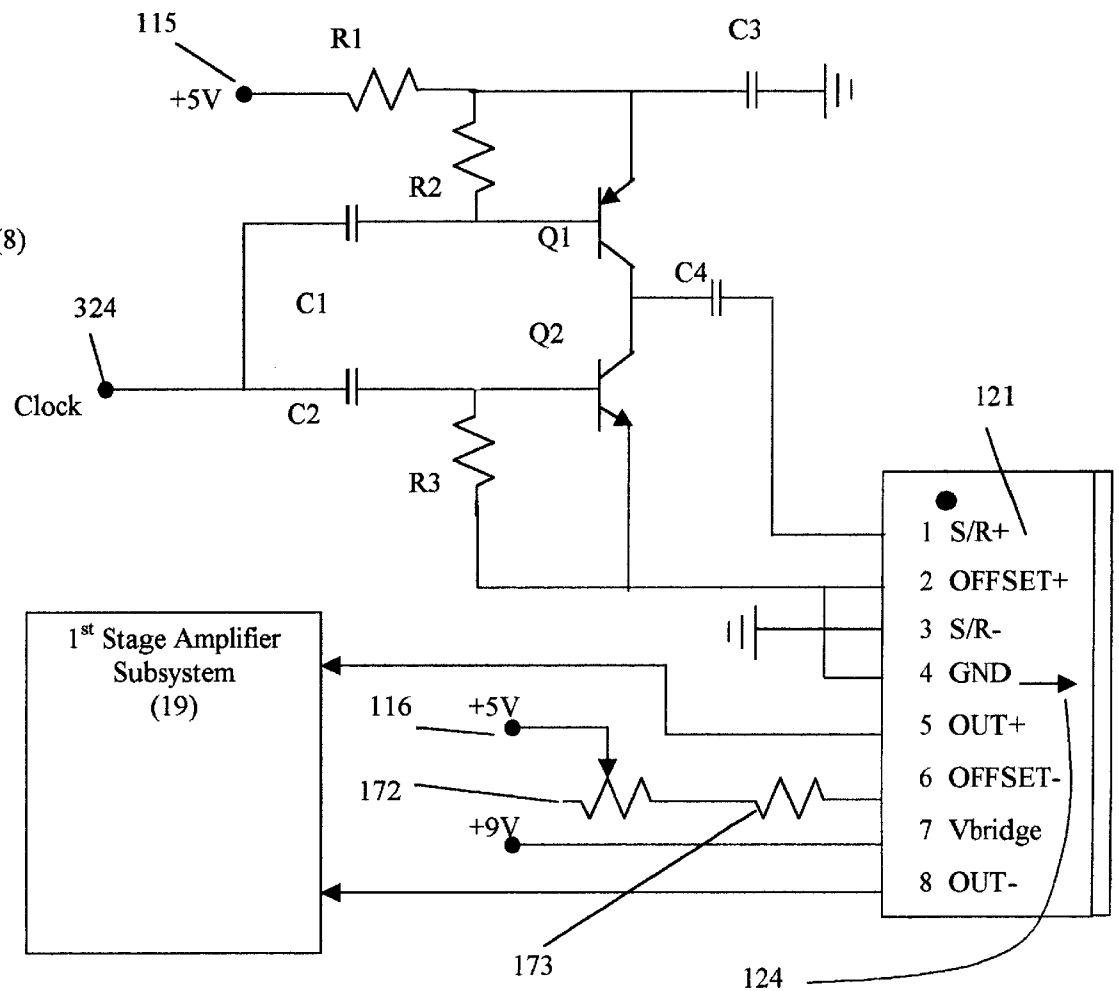
FIG. 14 is a schematic diagram for the circuit connections required by an HMC1001 Honeywell magnetoresistive sensor.

Note that in FIG. 1 the sensor 17 is generic and could be one of a variety of sensors; this is contrasted with the HMC1001 Honeywell magnetoresistive sensor 121 which is used in the preferred embodiment and is shown in FIGS. 11 and 14. The set/reset pulse generator 18 is not generic and specifically applies to the Honeywell magnetoresistive sensor 121. Typically whatever sensor is used will require other, supportive circuitry to maintain its sensitivity and so the set/reset pulse generator is a specific example of the more general case of supportive circuitry.

The auto-center subsystem receives a low-level signal from the $1^{st}$ stage amplifier subsystem at a time before the magnetic field from the active component is substantially present. It then holds this voltage and presents it to the $2^{nd}$ stage amplifier subsystem as a base value to be subtracted from the ongoing low-level signal it receives (when the active component's field is a factor).

The auto-center subsystem is comprised of sample-and-hold circuitry. When it receives an auto-center control signal 318 from the controller module 46, it samples the low-level output signal 312. It then holds this signal on its output pin as the reference signal 315. The idea is that once the system is positioned at a given exercise station, an auto-centering pulse occurs to zero out any ambient fields and create a new baseline.

This auto-centering is done before the active agent of a given sensor (in this case a magnetic field) is significantly present. The magnet is not placed within the range of motion for the moving object of interest until the system is positioned and auto-centered. It is currently possible to buy sample-and-hold integrated circuits that provide both the sampling means and holding means in one chip.

Once the auto-centering has occurred, the active agent (in this case a magnetic field) can be engaged creating an active condition for monitoring, but where ambient active agents have been subtracted out.

Figure 13:
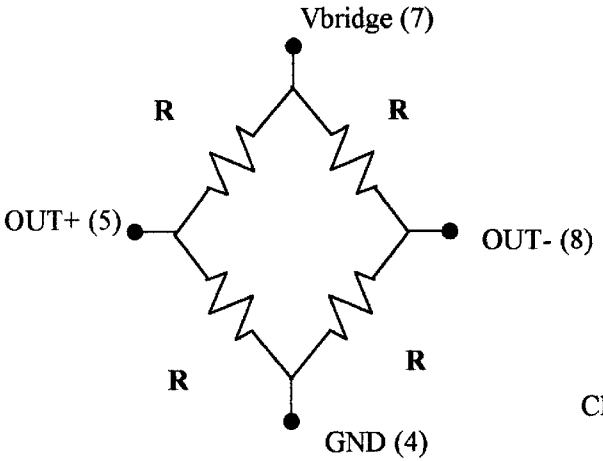
FIG. 13 is a schematic diagram representation of the active components in an HMC1001 Honeywell magnetoresistive sensor.

The sensor behaves like a Wheatstone bridge (FIG. 13). In the absence of a magnetic field all the resistors have the same value and no voltage difference appears across the outputs. The resistors change their value as a magnetic field is applied, and a voltage difference appears proportional to the field. Greatest sensitivity is in the direction of sensitivity vector 124 relative to the sensor itself. If a moving object of interest approximately follows the sensitivity vector originating at the sensor (path of greatest sensitivity), then greatest sensitivity will be obtained. The sensor requires a set/reset pulse generator 18 (FIGS. 1, 11) to periodically restore its sensitivity.

When the controller module generates a set/reset control signal 324, the set/reset pulse generator 18 restores sensitivity. It does this by first generating a large current pulse in one direction of an internal set/reset strap, and then generating a large current in the opposite direction. The pulses in both directions are for such a small fraction of a second that the effective current drain on a power supply is only a few milli-amps even though the pulse itself is approximately four amps.

A schematic for the set/reset pulse generator is provided in FIG. 14. This figure also indicates how the other connections are made to the sensor. Note that the set/reset pulse circuitry is not contained on the sensor board but rather on the nearest end of the top board 109. If room can be made on the sensor board, then placement of the set/reset circuitry closer to the sensor is desirable.

As can be seen in FIG. 1, the output from the sensor is attached to the input of the $1^{st}$ stage amplifier subsystem, whose output is attached to the input of the $2^{nd}$ stage amplifier subsystem. The output from the $2^{nd}$ stage is attached to the input of the ADC subsystem, whose output is attached to the controller module.

The output of this logical group is a digital signal representing a voltage level which in turn is linearly related to the intensity of the applied magnetic field. The sensor is capable of detecting a small magnet from several feet away. The controller module then evaluates these digital signals and uses them to determine when the small magnet has passed a triggering threshold. At that time the controller module generates sensor data signals comprised of time information (such as clock ticks that have elapsed since the last detected iteration) and configuration information (such as station ID, weight, and distance of travel).

Another logical group provides the power supply means. The nine-volt battery 301 and battery clip 302 provide power to the circuit power rails (positive nine volts 300, ground 303) when the on/off switch 34 is activated. Note that the controller module in this case also provides the +5 volts for voltage-regulated supply 115 in FIG. 14. The +5 volts providing negative current in, voltage-regulated supply providing negative current 116, may be provided by a voltage-reference pin of an instrumentation amplifier integrated circuit, such as the INA125.

Another logical group provides the device output means. This includes the speaker 37 and display module 43, plus any optional LED status indicators. The speaker receives audio output signals (audio signal 330) generated by the controller module. These audio output signals can represent audio cues that instruct and inform the user without requiring the user to look directly at the system. The display module is an LCD display with two lines of sixteen characters per line and a serial interface to the controller module 46, such as those available from Parallax, Incorporated. The display receives output signals from the controller module.

Yet another logical group provides the user input means. This includes the keypad 64 and keypad encoder module 52, plus the setup/log button 58 and the start/stop button 61. The setup/log button and start/stop button both provide simple logic signals that the controller module 46 detects and can act upon. The keypad is a Grayhill model 86 with four rows and five columns of keys, a matrix interface, front-mount flange, and is not back-lit. The nine signals from the keypad are converted by the keypad encoder into a serial data signal for the controller module. The keypad serial data 336 from the keypad encoder plus the button signals 339 comprise the input signals to the controller module.

Another logical group provides a clock subsystem 49. This essentially counts clock ticks. The subsystem can reset the counter, and can query the counter to determine how many clock ticks have elapsed since the last time the counter was reset. This provides an accurate way for the controller to determine time intervals independent of the controller's own processing latencies. Clock tick counting circuits such as this are readily available in circuit cookbooks or on the Internet, but an alternative also exists. One may alternately use a clock module purchased from companies such as Parallax, Incorporated. Their Pocket Watch module has a serial interface and provides the date plus hours, minutes, and seconds.

Figure 12:
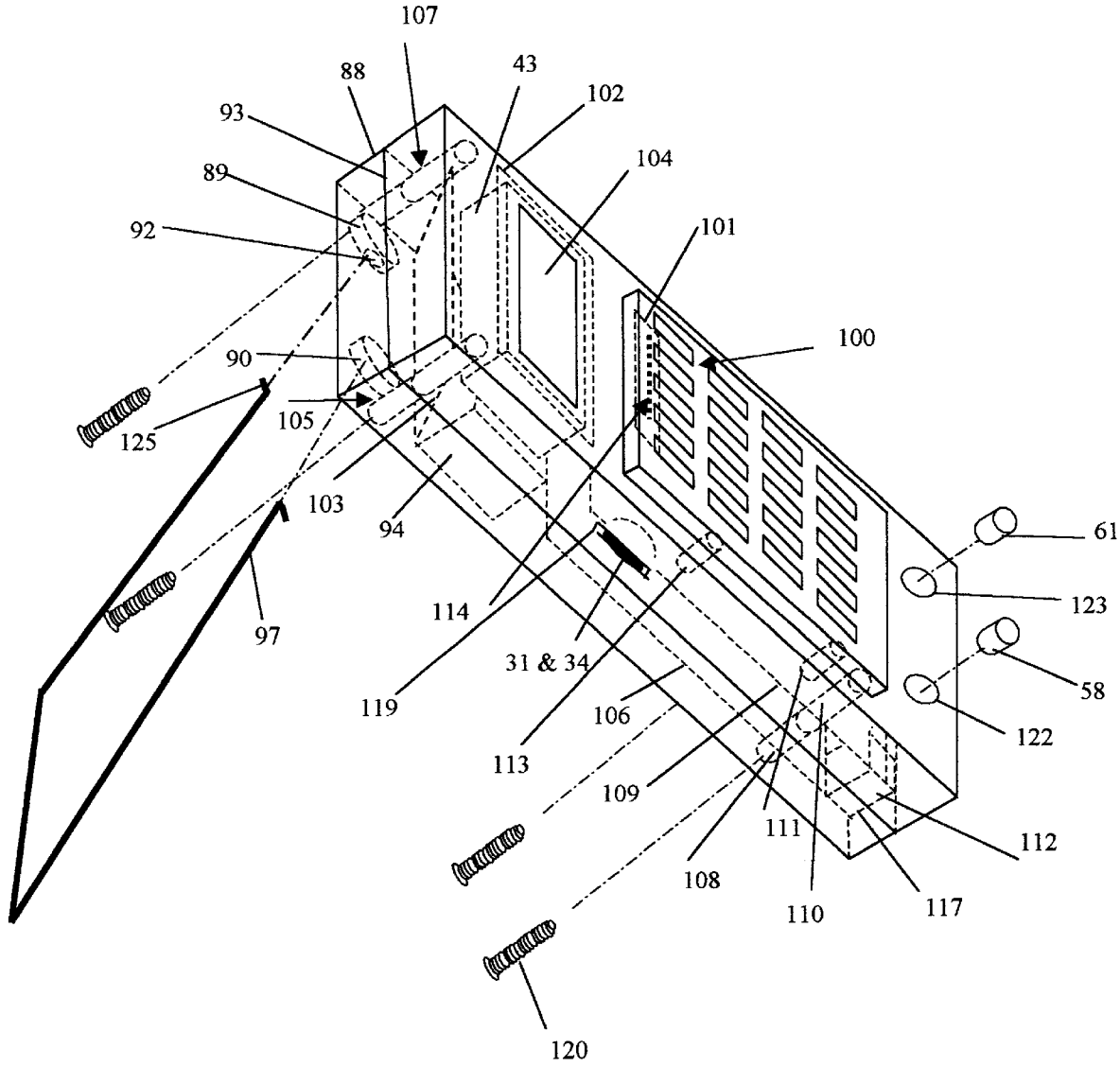
FIG. 12 is a drawing of the complete system.

Description of the Preferred Embodiment—Complete System (FIG. 12)

FIG. 12 shows the main components of the invention, a portable computerized system 79 (or simply "system") as they relate to one another. The system has a case 88 and it is typically made of plastic. The case is divided in half as indicated by the join line 93. Each case half has a set of four case joiners located symmetrically about the case, such as top case joiner 110 and bottom case joiner 108. A top case joiner mates with a bottom case joiner to form a case joiner such as case joiners 105 and 107. The components are assembled into the case halves and then the case halves are connected together by means of long screws, such as long screw 120, through the four case joiners.

The dimensions of the case are not critical. A size of 7"×1.75"×4" provides adequate room for all the components but smaller cases can be used if surface-mount technology is implemented. The case has a battery compartment 94 located near the top of the case and accessed from the underside. The compartment is large enough for a single, standard nine-volt battery 301 and battery clip 302 (see FIG. 1). The case has a display cutout 104 and a display bezel 102 to accommodate the LCD display 43. The display cutout has dimensions of 2.6"×0.9". There is a metal stand 97 that folds against the back of the case for storage. The metal stand has a stand bend such as stand bend 125 on each side. Each stand mount (89,90) has an orifice such as mount orifice 92. The stand bends attach to the stand mounts through these orifices. A case such as this may be purchased through many electronic part suppliers; many general hobby cases adequately contain these features. The entire system is small enough to carry in one hand.

The case has a communication jack cutout 117 to accommodate an RJ-11 communication jack 112. The communication jack cutout may be positioned anywhere along the bottom edge of the case and has dimensions of 0.62"×0.52". The RJ-11 communication jack is shown in FIG. 12 as being positioned near the left edge of the case, or alternately it is shown in FIG. 11 as being centered on the bottom edge of top board 109. The RJ-11 communication jack may be mounted to the case or positioned on the bottom side of top board 109 and soldered into place. Other types of jacks may be used, but a minimum of four conductors is needed for this design.

A thumbwheel cutout 119 on one side of the case (left or right) accommodates placement of the integrated on/off switch 34 and gain potentiometer 31. The slot has dimensions of 0.12"×0.85". Turning the thumbwheel of the on/off switch causes the system to click into the "on" setting; continuing to turn the thumbwheel exercises the gain potentiometer and increases the gain. The integrated on/of switch and gain potentiometer is soldered into place in the integrated switch cutout 151 of top board 109 (FIG. 11). Other types of switches may be used and they do not need to be integrated. It is necessary to have an on/off switch, and it is necessary to have a method for controlling the amplifier gain (or the system's sensitivity). The range of the potentiometer (as measured in Ohms) will depend on the amplifier design used.

Two button holes (122, 123) are positioned in the case to allow installation of the setup/log button 58 and the start/stop button 61. The button holes may be located on the front or side of the case and have diameters of 0.40". The setup/log button 58 is push-on/push-off, whereas the start/stop button 61 is a momentary-on button. The buttons may be mounted to the case, or soldered to the top board 109 (if mounted on front of case) or soldered to the bottom board 106 (if mounted on a side of case).

The display module 43 has two lines with sixteen characters in each line and uses a serial interface. These displays are currently available as modules supporting either parallel or serial interfaces, such as from Parallax, Incorporated. The display module may be bolted to the case, or glued into place.

The keypad 100 shown is a Grayhill Model 86 and has four rows and five columns and a matrix interface of nine signal lines, and is front-mounted with a flange. The keypad pins 114 pass through the keypad pin cutout 101 in the case. The keypad may be glued in place or preferably mounted to the case with small bolts and nuts.

Great variation is possible in the selection of components that comprise the interface between the system and the user. A great many types of switches and buttons and jacks and keypads and displays are available for example, and it is a straightforward matter to modify the design to accommodate the dimensions of a given component. Switches and buttons and jacks may come with hardware for mounting them to the case, or they may be designed to be mounted onto a printed circuit board—either approach can be made to work. Greater or lesser numbers of keys on the keypad may be used (with necessary changes to the software logic), as may unique-shaped keys or keypads with custom legends, or back-lit keypads, or back-mounted keypads (with appropriate modification to the case). The displays may have more or less lines, or more or less characters per line, or may be larger or smaller, or back-lit, for example.

The case also allows for great variation. Much smaller and sleeker cases are possible, especially if surface-mount technology is used for the components.

Description of the Preferred Embodiment—Circuit Boards (FIGS. 11,12)

In FIG. 12 three printed-circuit boards are shown installed inside the case. The sensor board 103 is located near the top of the case, and positioned at an angle with respect to the case's longitudinal axis. The bottom board 106 and top board 109 are positioned parallel to the longitudinal axis.

FIG. 11 indicates the placement of modules and subsystems on the three boards. All parts are placed on the top side of a board unless otherwise specified. The sensor board 103 houses the HMC1001 Honeywell magnetoresistive sensor 121, and has room for the $1^{st}$ stage amplifier subsystem 19. There is a trim pot 172 and current-limiting resistor 173 (FIGS. 11, 14) for adjusting a negative current to the offset strap of the sensor. There is an area for soldering a ribbon cable from a top board 109 to the sensor board (ribbon cable connector 175). The ribbon cable is conventional and not displayed.

Four signals are sent to the sensor board from the top board: positive nine volts 300, ground 303, set/reset pulse 306, and sleep 309. One signal is sent from the sensor board to the top board: low-level output signal 312. These signals are shown in FIG. 1.

The $1^{st}$ stage amplifier subsystem typically consists of an instrumentation amplifier configured as a bridge amplifier. A Burr-Brown INA125 precision instrumentation amplifier is one example of a chip that can form the basis for this amplifier subsystem. A chip such as this can be configured for single-supply operation, plus provides various reference voltages. This chip has a five-volt reference that can be used along with a transistor to provide the necessary current for the offset strap of the sensor. The offset strap could be powered directly from the battery, but a precision reference such as from the INA125 will not drift over the usable life of the battery. The gain for this stage is suggested to be under one-thousand.

The sensor board should be placed at an angle inside the case such that it approximately points straight upward, normal to the floor, when the metal stand 97 is used to position the device.

FIG. 11 shows a top board 109 has a connector 160 for a ribbon cable coming from the sensor board. The connector is placed on the bottom side of the top board. It also allows the eight-conductor ribbon cable to have three conductors split off to go to the LCD display module 43 (FIG. 12). These three conductors carry the signals: positive five volts 304, ground 303, and display serial data 321 (see FIG. 1).

There are four screw holes 142, 143, 146, and 147 for attaching the top board to the top of the case. The size of screws used in the mounting holes is not critical. There must be four mounting posts, such as 111 or 113, to accommodate the screws. Additionally, there are two guide holes 144 and 145 that slide over two of the case joiners and allow for quick positioning of the circuit board.

An area of the top board is reserved for the $2^{nd}$ stage amplifier subsystem 22 and the auto-center subsystem 25.

The $2^{nd}$ stage amplifier subsystem is configured as a difference amplifier. It takes the low-level output signal 312 from the $1^{st}$ stage amplifier subsystem, compares it to the reference signal 315 from the auto-center subsystem, and amplifies the difference. It produces the high-level output signal 327. The gain resistor 28 and gain potentiometer 31 control the gain range of this stage. The gain range is suggested as being between one and some value under a thousand.

The $1^{st}$ stage amplifier subsystem and $2^{nd}$ stage amplifier subsystem and auto-center subsystem can be built by anyone skilled in the craft of circuit construction. Many circuit "cookbooks" exist that detail the construction of bridge and difference amplifiers and sample-and-hold circuits, as do the application notes for specific chips such as the above-mentioned INA125.

There is a keypad cutout 157 to accommodate the nine pins of the Grayhill keypad that pass through the front of the case. A conventional ribbon cable (not shown) attaches the pins to a keypad cable connector 126 positioned on the bottom side of the top board.

There is space for positioning of a speaker 37 and a speaker magnet cutout 154 that allows the speaker magnet to pass through the circuit board. This allows for the speaker to be held rigidly in place. The speaker should have as small a magnet as possible if a magnetic sensor is used.

There is a space for the set/reset pulse generator 18 as described earlier when talking about the sensor board 103.

A keypad encoder module 52 is used to convert the matrix signals from the keypad into a single serial signal, plus provide buffering of keystrokes. The keypad encoder module is positioned on the top side of the top board and receives the signals from the keypad cable connector 126. Many companies, such as Parallax, Incorporated, provide modules such as the MemKey Encoder Module to do this. The MemKey Encoder Module has a keypad buffer signal 342 to alert the controller module that a key has been pressed. It also has a line for keypad serial data 336.

The RJ-11 communication jack 112 is shown as a board-mounted version, positioned on the bottom side of the top board. It has four conductors and may have support posts for positioning it at an angle.

There is a male connector 148 that is used to communicate with the bottom board 106. Many signals are communicated across this connector between the top and bottom boards. These signals include, but are not limited to: positive nine volts 300, ground 303, display serial data 321, set/reset control signal 324, high-level output signal 327, positive five volts 304, auto-center control signal 318, audio signal 330, communication signals 333, keypad serial data 336, and the button signals 339 (if start/stop button 61 and setup/log button 58 are soldered onto top board). See FIG. 1 for these signals. The male connector is placed on the bottom side of the top board and mates with the female connector 195 on the bottom board.

FIG. 11 shows a bottom board 106 that has a battery connector area 181 for soldering the power leads from the battery compartment 94. There is also a button connector area 190 for attaching the leads from the setup/log button 58 and start/stop button 61 if they are attached to the case. If they are board-mounted, then this would represent an area for where they would be soldered onto the board; it would be repositioned to either side of the circuit board.

The bottom board houses the controller module 46. This is a Basic STAMP IIE controller module, available from Parallax, Incorporated. It has a built-in five-volt regulated power supply, plus sixteen pins of I/O, plus 16 kilobytes of EEPROM storage, plus 64 bytes of scratch-pad RAM, plus a four-line RS-232 serial interface, plus a CPU, plus an embedded BASIC language interpreter. Extensive documentation of its features and how to use it, are available from the manufacturer.

A clock subsystem 49 is located on the bottom board and communicates with the controller module through a serial interface.

An ADC subsystem 40 is located on the bottom board. When it receives an ADC control signal 345 from the controller module 46, it takes the high-level output signal 327 from the $2^{nd}$ stage amplifier subsystem 22 and converts it into a 12-bit digital value (analog-to-digital conversion). The controller module waits a while and then reads the I/O lines for the converted value. Many integrated circuit chips are available to perform this function. Typically, to reduce the number of I/O lines used, they output a computed value in two parts—an upper 8-bit value and a lower 4-bit value. The two parts together comprise the complete 12-bit value.

The design as described herein requires 18 I/O ports and so the two least-significant of the eight I/O lines are sacrificed, since the Basic STAMP IIE controller module only has 16 lines of I/O. This reduces the granularity of the analog voltages that can be measured. Alternately, Parallax Incorporated has a new design of the Basic STAMP IIE controller module slated to be available in early 2001 that will have additional I/O lines.

The bottom board is attached to the bottom half of the case 88 by screws through screw holes 127 and 130 into mounting posts on the bottom half of the case. The board slides over two bottom case joiners via guide holes 128 and 129 and then is attached to the mounting posts with screws. The bottom board communicates with the top board by female connector 195 mating with male connector 148 on the top board.

Operation of the Preferred Embodiment (FIGS. 1, 11, 12, 14)

When the portable computerized system 79 (FIGS. 1,12) is being assembled, the trim pot 172 (FIG. 11) is used to supply a negative current to an internal offset strap of the HMC1001 Honeywell magnetoresistive sensor 121 (FIG. 14). This subtracts out the magnetic field generated by the system itself. A positive current may be needed, depending on the polarity of the field that the system is generating.

One way to describe the operation of the system is to describe a typical workout session in which the system is used. The system can be used for most repetitive-motion exercises, but for this description two variable-resistance exercise stations will be used: lat-pulldown, and bench-press. The user will download a preprogrammed exercise routine, complete the routine, and then do some ad-hoc exercising.

Operation of the Preferred Embodiment—Initial Setup (FIGS. 1,11,12,15, and Software Pseudocode Listing)

The user attaches a cable between the host computer and the system's RJ-11 communication jack 112 (FIGS. 11, 12). The user turns on the system by turning the thumbwheel of the integrated on/off switch 34 and gain potentiometer 31 as shown in FIGS. 1 and 12.

When power is applied to the controller module 46, it automatically begins its program. See the software pseudocode listing. An initialization logic block 430 is executed which among other things sends set/reset pulses 306 to an HMC1001 Honeywell magnetoresistive sensor 121 plus it sends an auto-center control signal 318 to an auto-center subsystem 25 (see FIG. 1). These initializations are also performed during the setup phase for each exercise station. The program then enters the main loop 433 as seen in the software pseudocode listing. Another program is also running on the host computer, and it has profile data and preprogrammed exercise routine data ready to download to the portable computerized system (or simply system) 79. The profile data has initial weight and distance values, plus optional descriptive character strings that describe the exercise stations of interest for a given workout.

The system's program solely checks for key presses, using the keypad interface logic block 400, until an exercise station is specified. The user can perform a variety of actions such as input the weight to be moved at an exercise station (input weight logic block 436 using weight button 509). The user additionally can input the distance the weight will be moved (input distance logic block 439 using travel button 512). The user can also modify options by pressing the shift button 533 and then the zero/options button 530. The enter key 521 is used to indicate the completion of entering data, or for selecting an item from a list of items. See FIG. 15 for the various buttons on the keypad.

The user has not yet selected an exercise station, or pressing the shift button 533 plus the down navigate/station button 503 would show the current station. This same button sequence would allow the user to then use the navigation buttons (down navigate/station button 503 and up navigate/ statistics button 506 and menu navigate logic block 442) to select a desired exercise station. In this example the user does not want to manually select stations but rather use a preprogrammed exercise routine.

Figure 15:
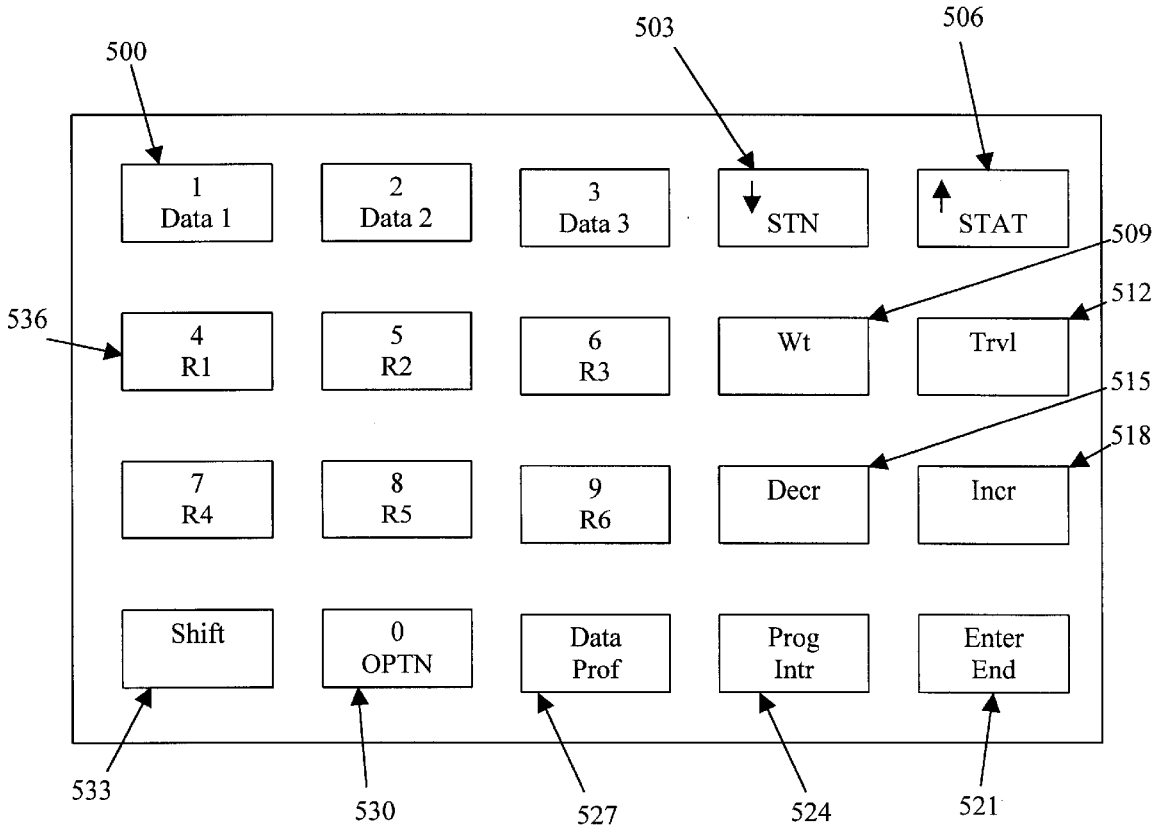
FIG. 15 shows the layout of the keyboard to work with one embodiment of a user interface.

Note that button sequences relating to exercise stations, statistics, and options all have submenus that can be navigated with the navigation buttons. FIG. 15 shows that some keys have an upper and lower definition, such as the program/interrupt button 524. The upper definition is available by pressing the given button, but the lower definition requires the shift button 533 to first be pressed.

Other buttons, such as number/data button 500 are useful for entering numbers 1–3 or up to three custom data values (if the shift button 533 is first pressed). Custom data values can represent anything the user wishes and is basically a note-keeping facility for each exercise station. Yet other buttons, such as number/reserved button 536 are useful for entering numbers 4–9 or are available for reserved features (if the shift button 533 is first pressed).

Reserved features can be anything, such as setting mode bits in a set header 200. A mode bit would describe the way the repetitions in a set are performed. A "one-second up, hold two seconds, one-second down" pattern could be one of several possible modes.

The decrement button 515 and the increment button 518 are useful for adjusting the weight or distances for a given exercise station without having to type in complete new numbers. For instance, if the current weight is set at one-hundred pounds and the default increment amount is ten pounds, then pressing the decrement button once would raise the amount to one-hundred and ten pounds.

Operation of the Preferred Embodiment—Preprogrammed Exercise Routine (FIGS. 1, 2, 3, 9, 15)

Figure 9:
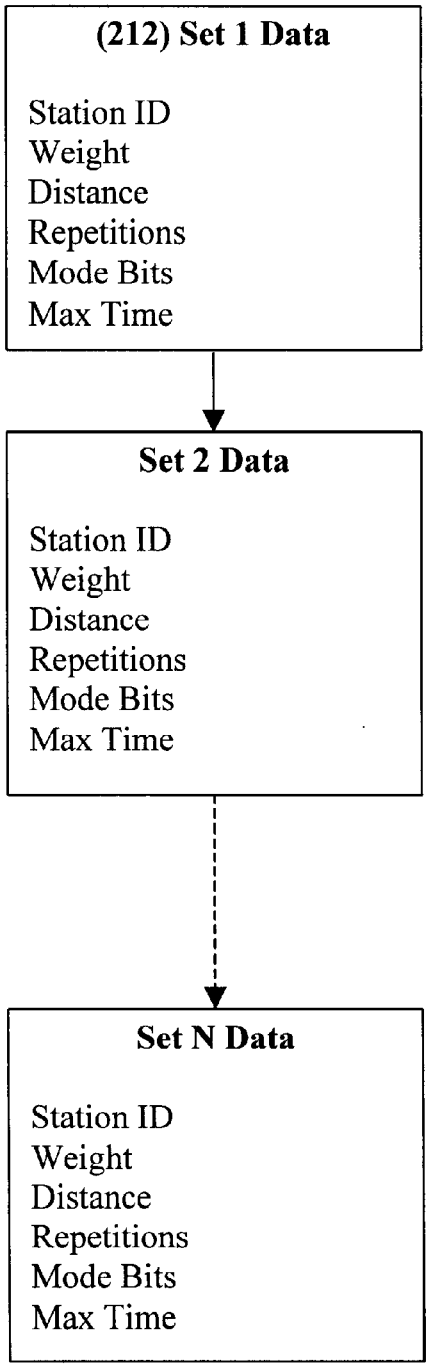
FIG. 9 shows one example of the internal data format used by the system for storing preprogrammed exercise routines.

In the case of this example, the user wants to download a preprogrammed exercise routine and use it. The user initiates a download on the host computer then presses the shift button 533 plus the upload/download button 527 to activate the download profile data logic block 445 on the system (FIG. 15 and software pseudocode listing). The data is downloaded to the system and placed in the appropriate memory locations. The format of the downloaded data that relates to a preprogrammed exercise routine is shown in FIG. 9. General profile data is also downloaded and this merely contains a station ID, the starting weight and a starting distance of travel—this is useful so the user does not have to reenter this information for each workout session.

A station ID is typically simply a number from 1 to 255 (0 is reserved). Since the memory of the controller module 46 is extremely limited, the best solution is for the user to print out a sheet that maps station IDs to descriptive text strings. In this case Station 1 is "Lat-Pulldown" and Station 2 is "Bench-Press".

The user presses a program/interrupt button 524 and this performs a start preprogrammed exercise routine logic block 451 to set the system into a correct mode for running the preprogrammed exercise routine, then returns to the main loop 433.

The system now is in station mode (a specific exercise station has been set) and information regarding the first set (such as station ID, weight, distance, repetitions, and time allowed) is displayed to the user. The main loop 433 is watching for key presses plus now watching for if the setup/log button 58 (FIGS. 1,12) is pressed (by executing the setup/log interface logic block 401).

Figures 2, 3:
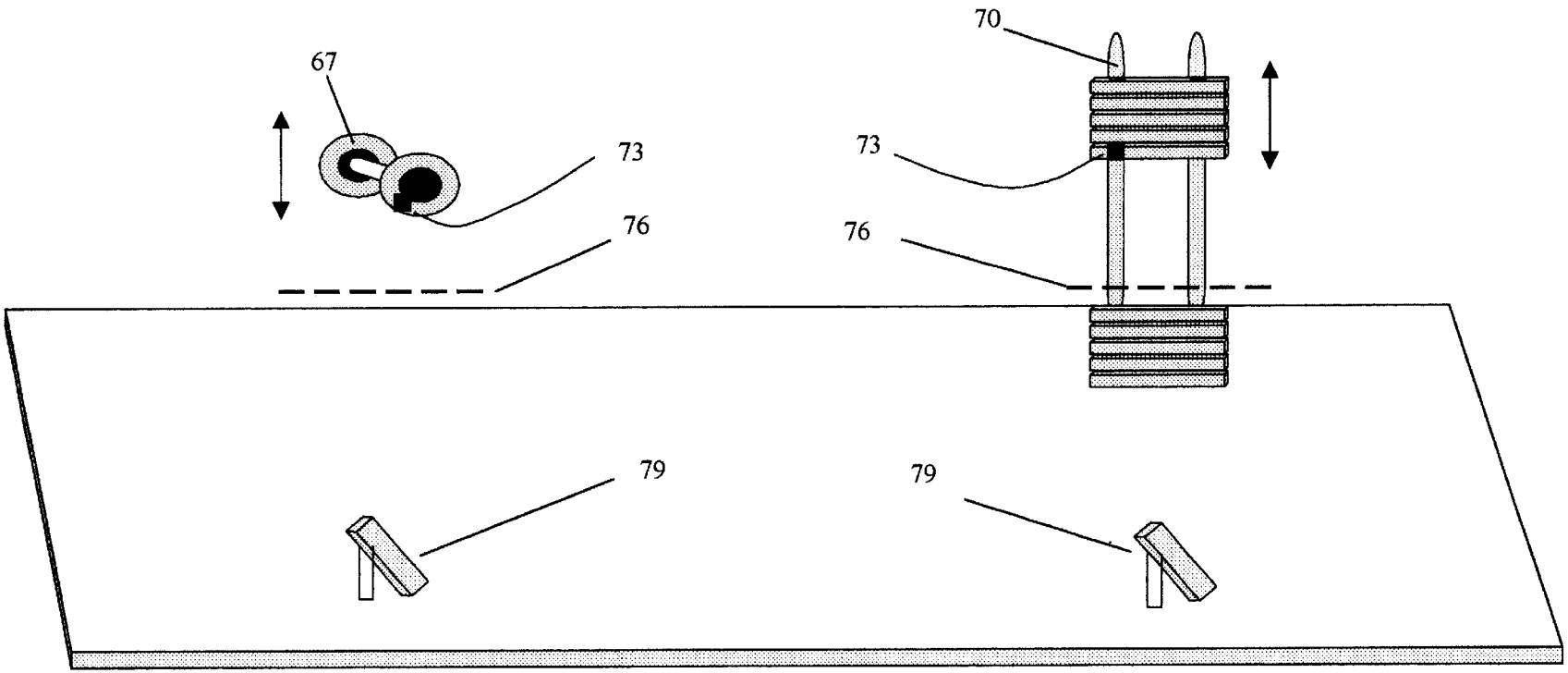
FIG. 2 shows an example of how the system is used with free-weight equipment.
FIG. 3 shows an example of how the system is used with variable-resistance exercise stations.

The user positions the system on the floor near the vertical stack of weight plates used by the variable-resistance exercise station 70 for lat-pulldowns. A small magnet 73 (FIG. 3) is placed on the bottom-most vertical plate that the user has selected. The user selects the amount of weight based on what the preprogrammed exercise routine instructs. The system is positioned so that the sensor points approximately at the magnet. FIG. 2 shows how the system would be positioned to work with a free-weight dumb-bell 67 (FIG. 2).

The setup/log button 58 is depressed so that the system is placed in setup mode as described by the setup/log button pressed logic block 454. A set/reset pulse 306 (see FIG. 1) ensures maximum sensitivity of the sensor. The auto-center subsystem 25 is activated by an auto-center control signal 318 to subtract out unwanted interference from ambient magnetic fields and other sources of signal drift. Thus, a set/reset control signal 324 and an auto-center control signal 318 are sent anytime the system is placed in setup mode.

The gain potentiometer 31 is turned by the user, increasing the gain, until a tone is heard. The potentiometer is turned slightly beyond that point so that a vertical plate will be detected before it reaches the bottom of its travel. This establishes the triggering threshold 76 (FIGS. 2, 3).

When the setup/log button is released, the system goes into a logging mode based on the enter logging mode logic block 457. The system in the main loop 433 is now watching for key presses, and continues to watch for if the system re-enters the setup mode (the system may need to be setup again). Additionally the system is watching for presses of the start/stop button 61 (FIGS. 1, 12).

Figure 7:
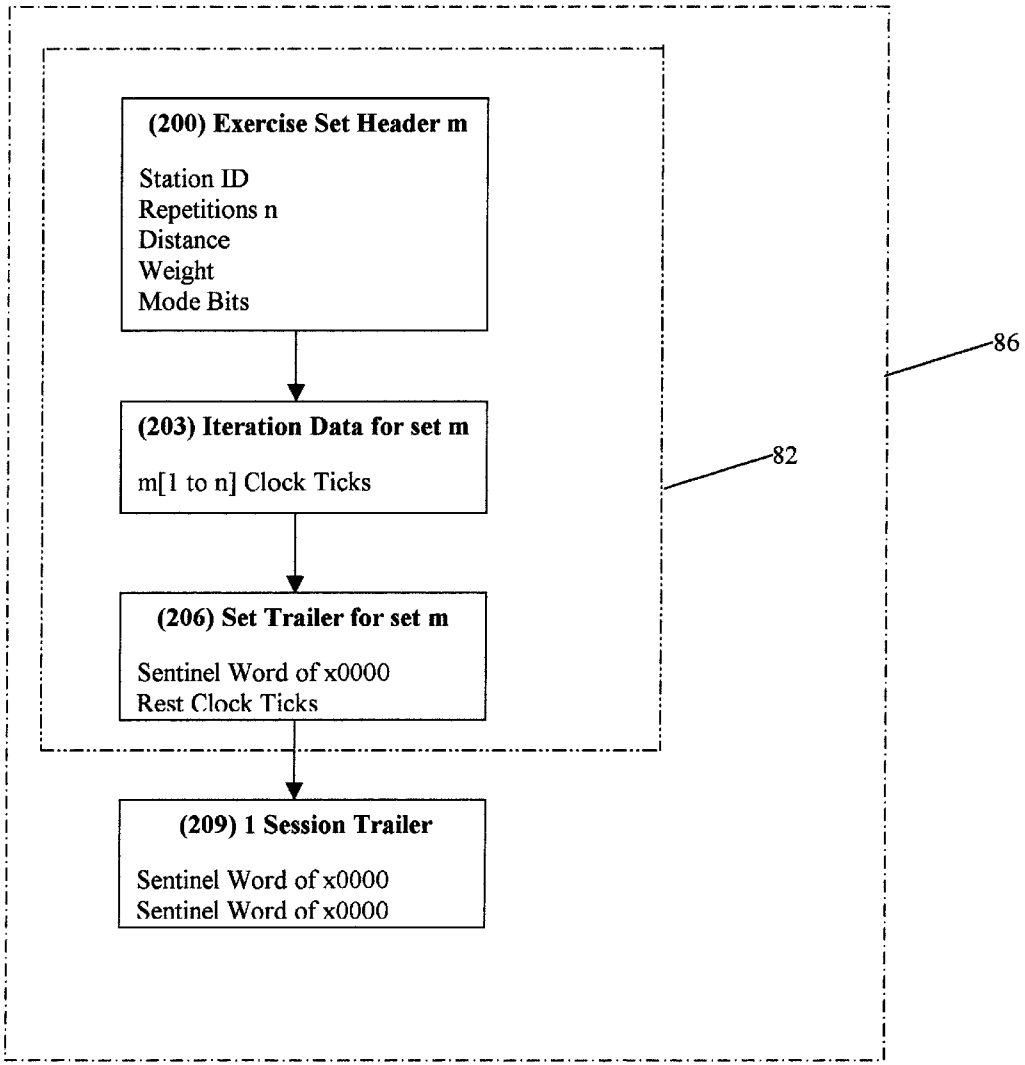
FIG. 7 shows one example of the internal data format used by the system for logging data.

The user then positions himself/herself on the equipment, and presses the start/stop button 61. When the user presses it, the start mode logic block 460 causes the system to go into start mode. The system writes a set header 200 based on the format in FIG. 7, then waits a few seconds (the amount is user-configurable) and then signals the user with a tone that it is time to start the set. Control is returned to the main loop. A pause occurs so that the user has time to move the plate above the triggering threshold 76, so that the plate initially resting at the bottom is not counted as a repetition. Then the pacing logic block 420 causes the logic elaborated in FIG. 10 to be executed. If the user were not using a preprogrammed exercise routine, then the logging logic block 410 would be entered.

Figure 10:
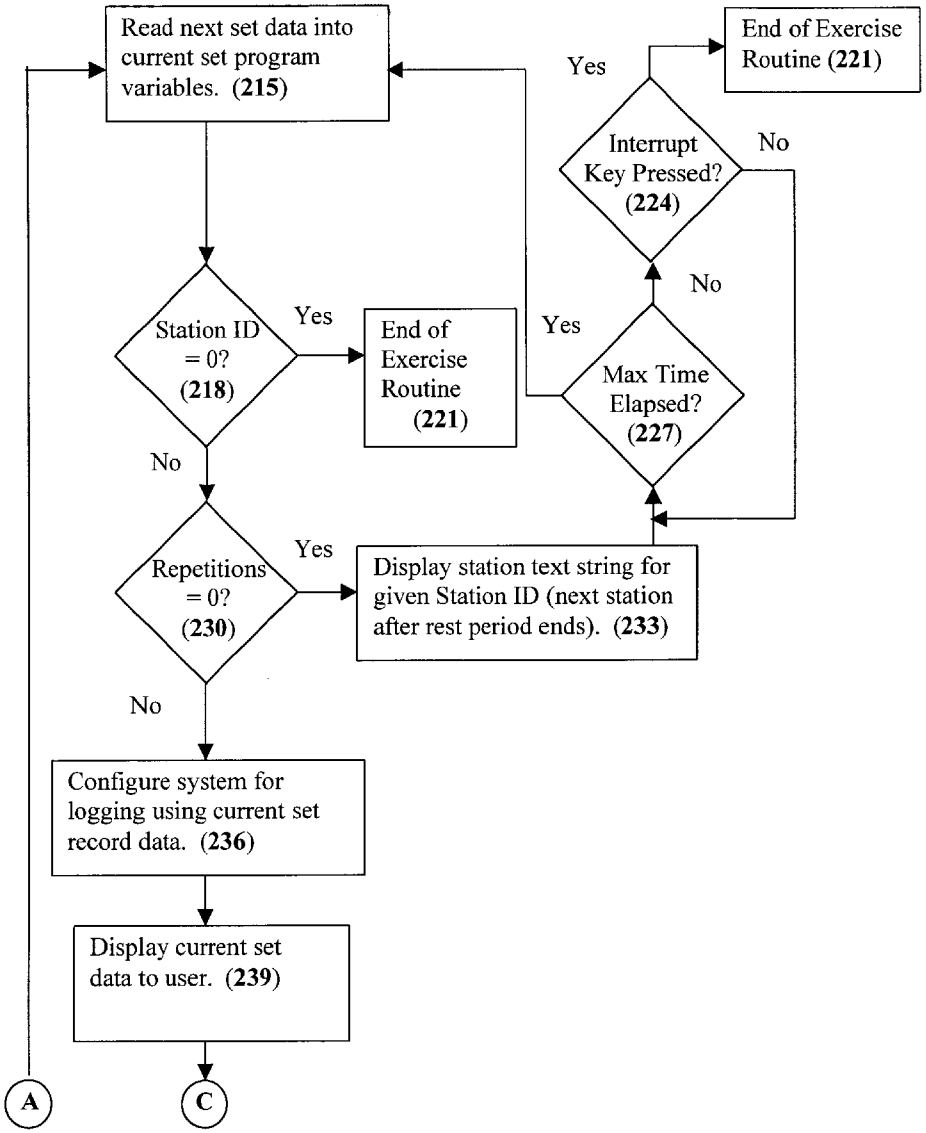
FIG. 10 is a flowchart describing the logic used to implement the preprogrammed exercise routine functionality.
Figure 10:
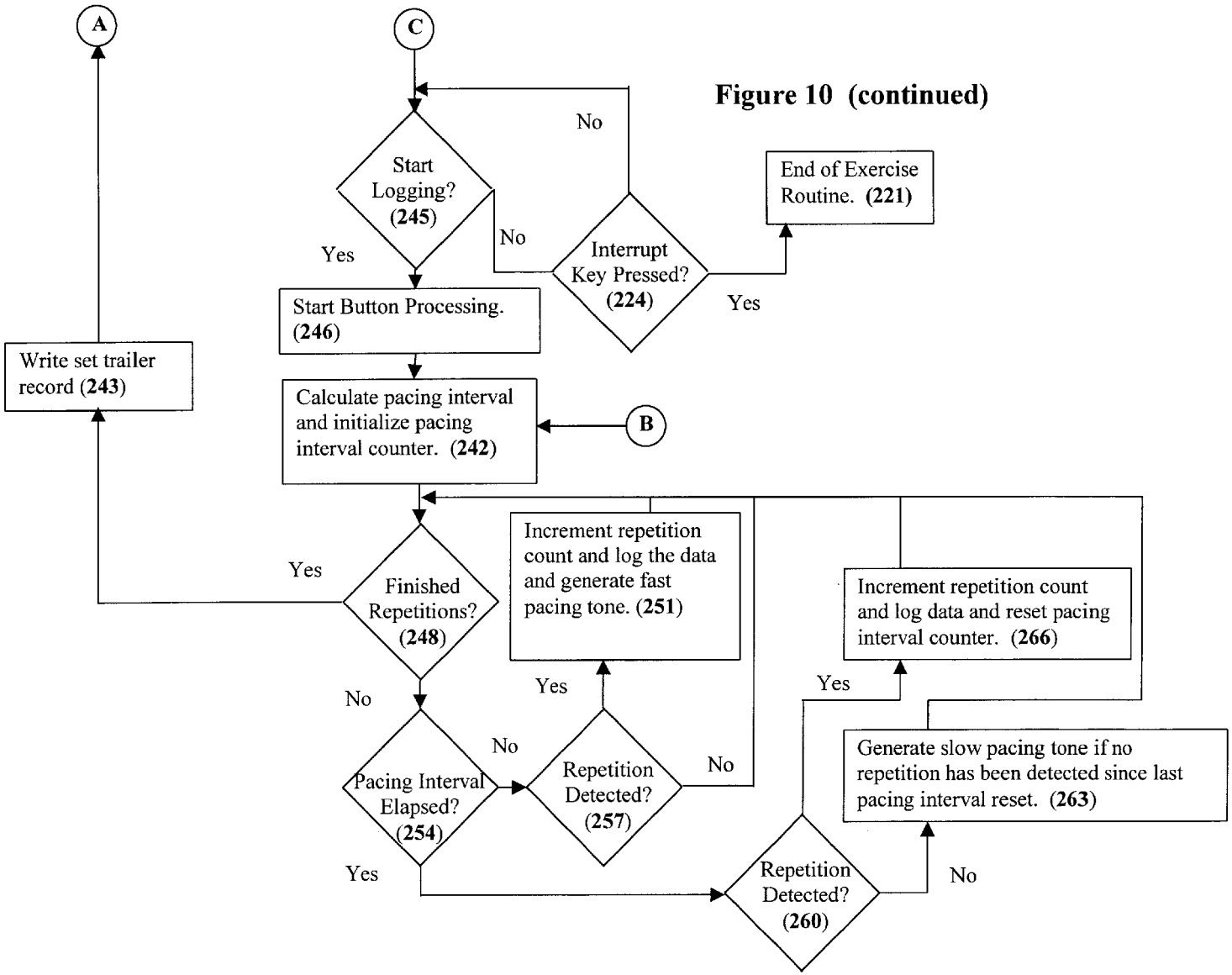

Operation of the Preferred Embodiment—Begin Preprogrammed Exercise Routine (FIGS. 9, 10, 15, Software Pseudocode Listing)

Control enters the logic elaborated in FIG. 10 at the point marked by an encircled "B". Records of exercise sets, in the format indicated in FIG. 9, are processed one at a time. Each set is stored in a fixed-length preprogrammed exercise routine data 212 record. Processing continues until a record with the station ID set to zero is processed. Such a record marks the end of the exercise routine as shown by end of session decision block 218 and return control to main program 221. The first exercise set record is not checked by the logic in this manner; only subsequent records are checked.

The first processing is to calculate a pacing interval based on the number of repetitions and the max time allowed for the set (initialize pacing program variables 242). Next a check is made to see if all the repetitions for the given set have been completed or if the shift button 533 plus the program/interrupt button 524 (FIG. 15) have been pressed (set completion decision block 248). They have not for this example. A loop through the pacing interval decision block 254 then the repetition detection decision block 257 and then back to the set completion decision block 248 is made until a repetition is detected or the pacing interval elapses.

If the pacing interval elapses then a repetition detection decision block 260 determines if a repetition is detected. If one is detected, then the reset pacing interval counter 266 logic is used to process the repetition, which includes logging the data. The clock ticks representing the repetition data 203 is logged using the data format of FIG. 7.

If a repetition is not detected then that means the user is working too slowly and a tone representing a "too slow" condition is made (processing for slow repetition 263).

If the pacing interval did not elapse, but a repetition is detected (repetition decision block 257) then that means the user is working too fast and a tone representing a "too fast" condition is made (processing for fast repetition 251). The clock ticks representing the repetition data 203 is logged using the data format of FIG. 7.

This continues until all the repetitions for the first set have been completed or the shift button 533 plus the program/interrupt button 524 are pressed. Then the write set trailer block 243 writes a set trailer record 206. Control and then control passes to process next set block 215, which reads data for the next set into the appropriate program variables. Note the encircled "A" and encircled "C" are used to connect the logic flow from page 8/13 to page 9/13 (since FIG. 10 requires two pages).

A check is made for whether or not the current set represents the end of the workout session by end of session decision block 218. If the station ID field is zero, then the set marks the end of the workout session and control is returned to the main program by return control to main program 221 (which first writes a session trailer record 209 to the data).

Next a check is made for whether or not the current set represents a rest period, by rest period decision block 230. If the repetitions field is zero, it means the set represents a rest period. If this is a rest period, then the display would indicate the next station the user is to use, and the length of the rest period as determined by the max time field (rest period processing 233). The program would loop around max time elapsed decision block 227 until the time for the rest period had elapsed or the interrupt key was pressed (interrupt key pressed decision block). After the rest period elapses, control goes to process next set 215, or if the interrupt key is pressed then control is transferred back to the main program (return control to main program 221). Note the "interrupt key" is the Shift [533]+End [521] key combination.

There are no rest periods in this example, so the second set represents bench-presses. The configure system for logging 236 logic sets program variables that normally would be set by the user or the profile (such as weight and distance and station ID). The display current set information to user 239 logic displays the station ID, weight, distance, and max time for the set, to the user.

The start logging decision block 245 has a similar function to the setup/log interface logic block 401 (see software pseudocode listing). It allows the user to enter the setup mode, and adjust the device sensitivity, then wait for the start key to be pressed. The start button processing 246 logic checks for the start button being pressed and implements logic similar to start mode logic block 460, including completing the previous set trailer record 206 (if one exists) by filling in a rest clock ticks field.

Processing continues in this fashion until the third set record is processed, and it marks the end of the workout session for this example. Control is then returned to the main program (see software pseudocode listing—put system into regular logging mode 421) where the system is placed into a regular logging mode. Thus the preprogrammed exercise routine completes, but the system can continue to log data. Additional logging for the exercise station that is described by the next-to-last set is possible, or the system can be moved to other exercise stations that are impromptu parts of the same workout session.

Operation of the Preferred Embodiment—Process Data

After completing a workout session, logged data representing a mathematical set of exercise sets 82 is stored on the system. Each workout session has one session trailer record 209. A mathematical set of workout sessions 86 can be stored on the system but is limited by the available memory.

The data is uploaded to the host computer 56 (FIG. 1) by attaching a cable to the portable computerized system 79 (or simply system) via the RJ-11 Communication Jack 112 which is part of the communication interface 55. The other end of the cable plugs into the RS-232 communication port on the host computer. Software to receive the data is started on the host computer and then the upload/download button is pressed on the system, activating the upload data logic block 448. All the logged data is transferred to the host and optionally some preprocessing of the data may occur at this point.

Figure 8:
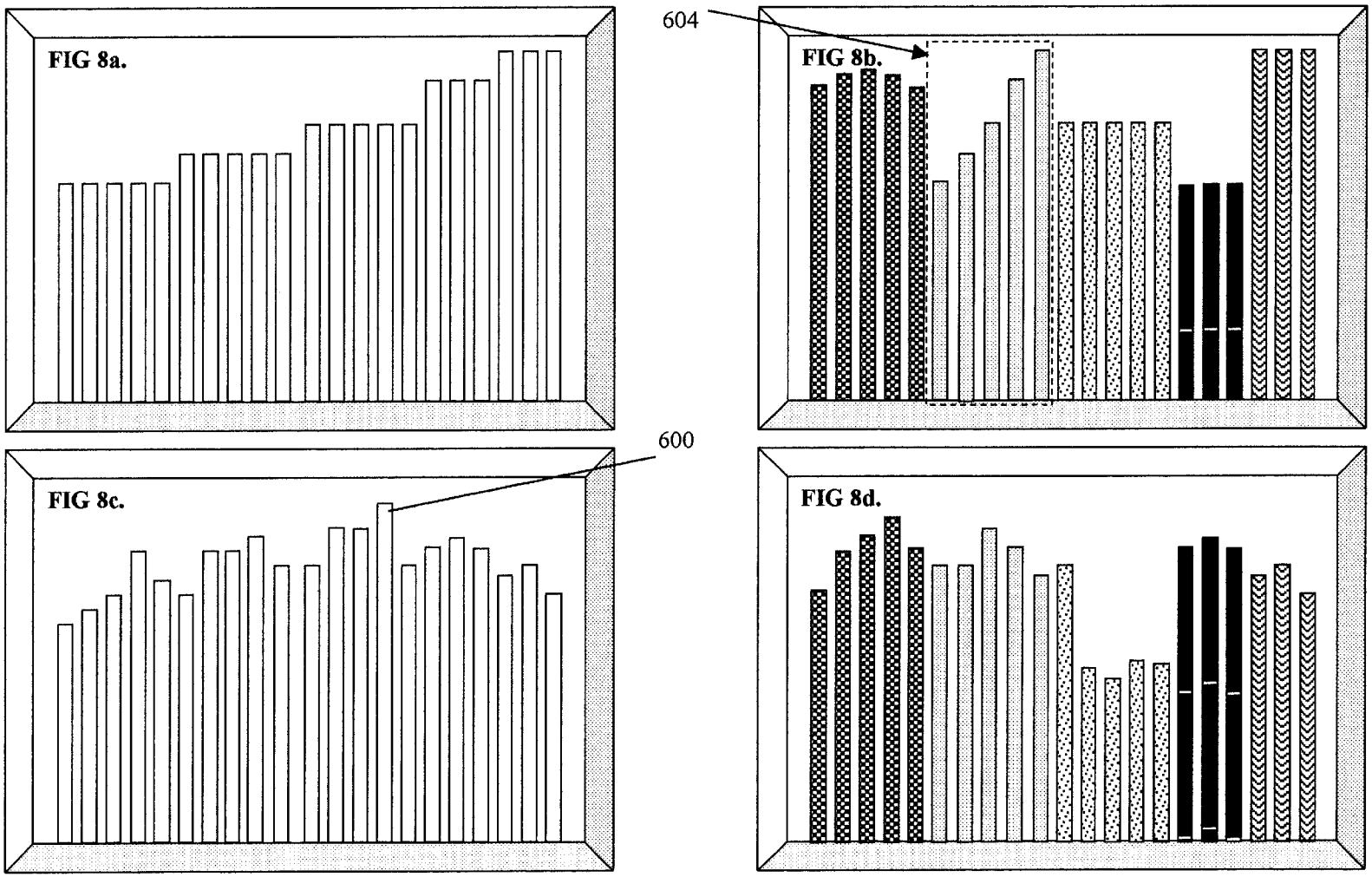
FIG. 8 shows examples of work and power graphs by exercise station and by workout session.

Once the data has been uploaded to the host computer, it can be graphed and analyzed. FIG. 8 shows examples of the types of graphs and analysis that can be performed. The software on the host system is not considered part of the portable computerized system and is not covered in this specification.

FIG. 8 shows work and power for an exercise station plus for an entire workout session. Note for the sake of generality that no units or legend are displayed.

FIG. 8(*a*) shows work data for an arbitrary exercise station. The data is comprised of five sets that contain five and five and five and three and three repetitions respectively. The level of work continues to increase throughout the five sets most likely because additional weight is added for each set. FIG. 8(*c*) shows power data for the same exercise session. Note that the power peaks at power peak 600, then decreases even as work continues to increase. This is possible because even though the work is increasing, it is being performed more slowly (thus with less power). The person most likely is tiring.

Power peak 600 may indicate the weight for this particular exercise station that allows the user to be in his/her "zone". One theory is that if a person can stay in their zone throughout an entire workout session, then their rate of development will be maximized. The zone is defined as the combination of variables that allows the user to do a large amount of work with a large amount of power (relative to the individual).

FIG. 8(*b*) shows work for an entire workout session. Five exercise stations are graphed with five and five and five and three and three sets in each, respectively. The set solid gray 604 is meant to display the data from the five sets in 8(*a*) relative to the four other arbitrary exercise stations. It can be seen that the station solid gray 604 is more variable than the other stations. This suggests that the user may be starting with too low of a weight setting.

FIG. 8(*d*) shows power for an entire workout session. The third station can be seen to have low power. This suggests that the user is too ambitious with the amount of weight used. The first station can be seen to have both high work and high power and appears to already be in a good configuration.

Description and Operation of Alternative Embodiments

Figure 4:
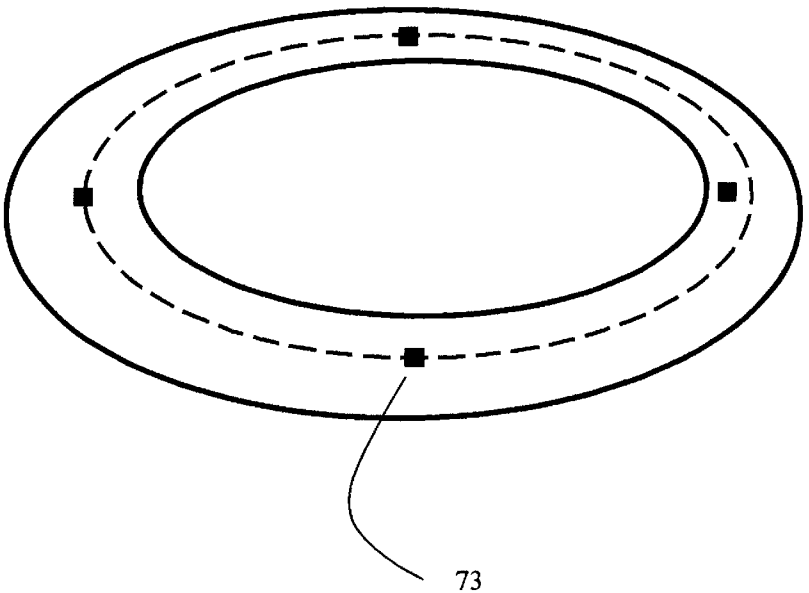
FIG. 4 shows an example of how the system is used in conjunction with a runner's training track (with embedded magnets for the magnetic sensor embodiment of system).

FIG. 4 shows a slightly different embodiment, mainly in how the portable computerized system 79 (or simply system) can be used. A running track can have magnets embedded in it at predetermined intervals in a lane, such as every ten meters. A magnetic-sensor version of the system can be worn on the lower back of the runner by means of a belt that attaches to the case, wraps around the abdomen, and attaches in the front of the person. The system should be positioned with the display toward the runner's back as this will position the sensor's sensitivity vector 124 to approximately point directly down.

The idea is that instead of collecting one time for when the runner passes over the finish line, a group of times that divide the track into lap segments can be logged for graphing and analysis. To obtain maximum performance from a runner proper pacing on a per-segment basis is necessary. The greatest overall time will be accomplished for a given individual runner by precisely determining where he/she should take their "extra breath". A system such as this allows precise experimentation with different pacing strategies and should greatly facilitate improved and individualized track running heuristics.

There is a magnet buried at the starting block and the runner uses this to perform setup of the system (by adjusting the gain potentiometer until a tone is heard), then placing the system in a logging mode. A partner, or possibly the runner themselves, place a finger on the start/stop button 61 and when the signal to start running is given, they press the button. The system is configured with zero lag time so it immediately starts the clock subsystem 49 counting ticks. Each time the runner passes over a magnet, the time is logged. A terminating magnet at the finish line (or starting line if they are the same) is used to log the finish time.

A preprogrammed exercise routine is possible where the runner is given pacing tones. For instance, the system could be programmed to give three tones and the runner knows he/she must be directly over the magnet by the end of the third tone.

Figure 5:
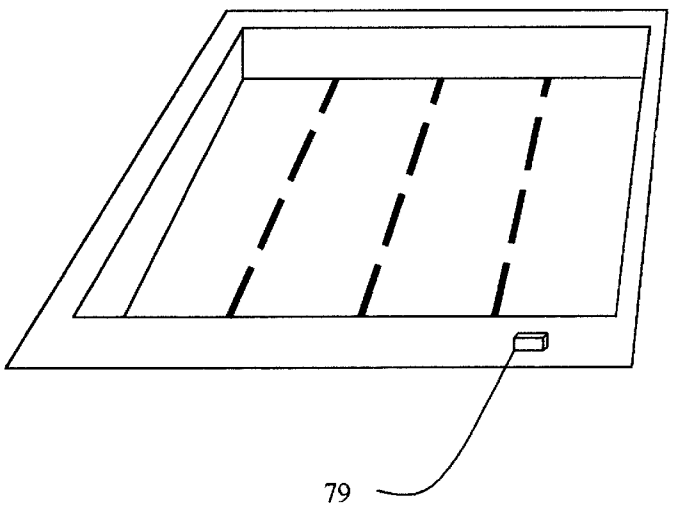
FIG. 5 shows an example of how the system is used in conjunction with a lap swimmer's pool (for magnetic sensor embodiment of system).
Figure 6:
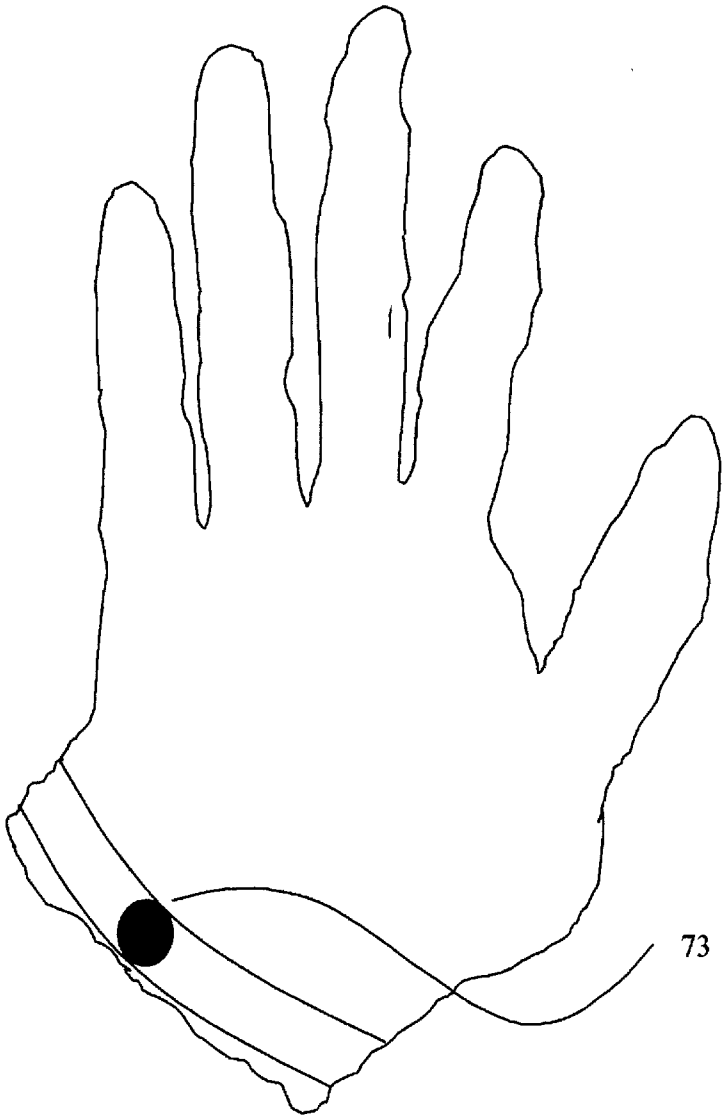
FIG. 6 shows how a person may wear a small magnet on the wrist for recording movement of the arm (for magnetic sensor embodiment of system).

Another embodiment uses the system to log laps as a swimmer performs them. FIG. 5 shows the portable computerized system 79 at one end of a pool. The swimmer wears a small magnet in a band on the ankle or wrist such as shown in FIG. 6. Once again the system is setup using the setup/log button so that the magnet is detected. Then at the signal to start swimming, a partner presses the start button.

Another embodiment would be as a sensing module for a general-purpose portable computerized system of Personal Digital Assistant (PDA) that would not require communication with a host computer. In this case, all of the essential analysis and graphing would be performed directly on the system. The analysis output would consist of statistics and graphs displayed directly on an output device comprised of a graphical display.

The inputting of user profiles and preprogrammed exercise routines would be done directly on the system. The exercise routine input would comprise an input device such as a keypad or touchpad display, plus software logic. One may still have a communication interface with a host computer but this would be for optional or secondary functions.

The system can be made smaller and lighter and more sleek in another embodiment.

Other sensors, such as ultrasonic or infrared may be used. Of particular interest is an ultrasonic or infrared range-finding sensor. This would allow for automatic detection of the distance of travel and would be useful in calculating velocity and acceleration of the moving part or body member. Note that rather than using a triggering threshold 76, such a system would log motion through the entire range of travel. The nearest point and farthest points would delimit repetitions, and the amount of distance traveled for each sensing unit of time would be logged to allow calculation of velocity and acceleration with greater granularity.

If the velocity and acceleration are more accurately known, more accurate work and power metrics can be calculated than those based strictly on time-stamped repetitions and Mode Bits. Ultrasonic and infrared range-finding sensors are currently available.

Whatever type of sensor is used, it is desirable to have an active component of the motion sensor or sensing means positioned directly on the moving object of interest. Each type of sensor responds to a different type of active agent. A magnetic sensor responds to a magnetic field. An ultrasonic sensor responds to ultrasonic waves. An infrared sensor responds to infrared waves, and so forth. If an active component is on the moving object of interest, it can generate the necessary active agent for a given sensor. In this way, surrounding objects can be ignored or filtered out, whereas with a strictly passive system, surrounding objects may interfere with the operation of the device.

Other techniques for magnetic sensors exist, such as coil, and Hall-effect. Other techniques for removing unwanted ambient fields or removing interference from equipment surrounding the moving part of interest can be used with these other sensors.

More elaborate displays and keyboards can be used such as displays with higher resolution, more lines, or touch displays.

Conclusion

Thus the reader will see that the portable computerized system 79 provides a highly flexible system for collecting performance data of most repetitive-motion exercises.

While my above description contains many specificities, these should not be construed as limitations on the scope of the invention, but rather as an exemplification of one preferred embodiment thereof. Many other variations are possible.

For example, sleeker and smaller cases 88 are possible. The positioning of the sensor 17 can vary as can the number and placement of the circuit boards (sensor board 103, top board 109, bottom board 106). A wide variety of amplifier circuit designs (such as $1^{st}$ stage amplifier subsystem 19 and $2^{nd}$ stage amplifier subsystem 22) may be used. A wide variety of electronic sensors may be used, including ultrasonic, infrared, range-finding, plus other types of magnetic sensors. The keypads can have different numbers of keys, different shaped keys, be backlit, bottom-mounted, have custom legends and more.

The display can have higher resolution, or more lines, or graphics, or be a touch-pad type display that replaces the keypad also. One embodiment would be for a Personal Digital Assistant (PDA) that allows the user to input a preprogrammed exercise routine directly into the unit. It would also allow the graphs to be directly generated and printed from the unit. A host computer would not be necessary.

Different sensors will require different supporting circuitry to remove unwanted or undesirable signals from consideration and protect from the many causes of signal drift. Different batteries (from nine-volt battery 301) and their required connecting hardware can be used, or an AC adapter can be used. The user interface can be designed in many different ways to provide different "look and feel" metaphors. A wide variety of user options and statistics can be made available.

A large number of controller modules 46 are available from different companies. Some allow code development in higher-level languages such as ANSI C, and support such features as hardware interrupts, more memory, more I/O lines, faster clock rate, etc.

Different clock modules 49 or subsystems are available that provide date and time or varying degrees of accuracy for split-second timing (tenths, hundredths, thousandths, etc.).

Different communication interfaces 55 are possible, using different connectors and different protocols.

Different sized and types of speakers 37 are possible. A variety of analog-to-digital converter chips are available allowing ADC subsystems 40 with different resolutions, speeds, and so forth. Encoder modules 52 do not even need to be used if the controller module has enough I/O pins. Alternately, a wide variety of encoder modules are available.

Accordingly, the scope of the invention should be determined not by the embodiment(s) illustrated, but by the appended claims and their legal equivalents.

The main purposes of this system are:

1) Record user data relating to ability to do work (not all of these will apply to a given exercise station).
   a) Name of the exercise station
   b) Amount of weight
   c) Distance of travel
   d) Number of repetitions (as detected by the sensor)
   e) Each repetition is time-stamped
   f) Each change of weight or distance of travel is recorded (if applicable for a given exercise station)
2) Lead the user through preprogrammed exercise routines (not all of these will apply to a given exercise station).
   a) Tell the user which exercise to perform via the display (LCD, touch-pad, etc.)
   b) Tell the user the initial setting for weight and optionally distance of travel via the display
   c) Set the pace for the repetitions, via audio or optionally visual cues
   d) Tell the user when to add or subtract more weights or optionally increase or decrement the distance of travel via audio or optional visual cues plus the display (how much to change)
   e) Tell the user when a set is completed via audio or optional visual cues plus the display.
   f) Tell the user when to rest, such as between sets via audio or optional visual cues
   g) Tell the user when to proceed to the next exercise via audio or optional visual cues plus the display (which exercise is next)
3) Provide a standard data port for the downloading of user profiles and pre-programmed exercise routines and other programs, plus uploading of collected data, to other computers for analysis. Alternately, provide input and output hardware and logic to input user profiles and pre-programmed exercise routines, and to graph the collected data, directly on the device itself.

I claim:

1. A portable computerized system comprising:

a) a sensing means operably attached to a controller means for detecting parameters of exercise performance and for providing sensing signals representative thereof and requiring at most a temporary attachment to any external exercise equipment, if any such said external exercise equipment is used, b) an integrated data memory means operably attached to a controller means for storing sensor data signals representative of exercise activity and for receiving said sensor data signals, c) a user input means operably attached to a controller means for providing communication from a user to a controller means by producing input signals, d) a clock means operably attached to a controller means for measuring time intervals, e) a device output means operably attached to a controller means for receiving said output signals which provide communication from said portable computerized system to said user, f) said controller means which will:
   i) evaluate said user input signals and produce said output signals,
   ii) evaluate said sensing signals as they vary over time and produce said sensor data signals representative thereof as modified by said user input signals,
   iii) record said sensor data signals in said integrated data memory, g) a power supply means for providing electricity to said portable computerized system, whereby said user can log performance data for an exercise session without requiring permanent modifications to any given said external exercise equipment if said external exercise equipment is used.

2. The portable computerized system of claim 1 further including an integrated routine memory means operably attached to said controller means, which is able to store an exercise routine data signal representative of a component of a preprogrammed exercise routine and with which said controller means will:

a) evaluate said sensing signals and produce said output signals which are modified or regulated by, said user input signals and said exercise routine data signals, whereby said user can be guided through a preprogrammed exercise routine which is dynamically regulated by said sensing signals.

3. The portable computerized system of claim 2 further including an audio output means operably attached to said controller means, for receiving audio output signals and with which said controller will:

a) evaluate said sensing signals and produce said audio output signals which are modified or regulated by, said user input signals and said exercise routine data signals, whereby audio cues comprised of said audio output signals are produced and dynamically regulated by said sensing signals.

4. The portable computerized system of claim 1 wherein said sensing means is based upon electronic manipulation of ultrasonic sound waves.

5. The portable computerized system of claim 1 wherein said sensing means is based upon electronic manipulation of light waves.

6. The portable computerized system of claim 1 wherein said sensing means is based upon electronic manipulation of magnetic fields.

7. The portable computerized system of claim 1, further including a normalizing means operably attached to said sensing means which can filter out factors which may affect sensor performance, comprised of ambient fields and temperature.

8. The portable computerized system of claim 1, further including an active component of said sensing means that is to be placed on a moving object of interest for the duration of said exercise session, whereby an active agent to which said sensing means is sensitive and selected from the group consisting of waves and fields, is produced.

9. The portable computerized system of claim 1 wherein said sensing means has variable sensitivity provided by a component of said user input means being operably attached to said sensing means, whereby motion of an object of interest can be detected at varying ranges to accommodate a wide variety of equipment configurations.

10. A portable computerized system comprising:

a) a motion sensor which is able to produce sensing signals representative thereof, operably attached to a controller and requiring at most a temporary attachment to any external exercise equipment, if any such said external exercise equipment is used, b) an integrated data memory operably attached to said controller, which is able to store sensor data signals representative of exercise activity, c) a user input operably attached to said controller which provides communication from a user to a controller by producing user input signals, d) a clock operably attached to said controller for measuring time intervals, e) a device output operably attached to said controller which provides communication from said controller to said user by receiving output signals from said controller, f) said controller which will:

i) evaluate said user input signals and produce said output signals, ii) evaluate said sensing signals as they vary over time and produce said sensor data signals representative thereof as modified by said user input signals, iii) store said sensor data signals in said integrated data memory, g) a power supply which is capable of providing electricity to said portable computerized system, whereby said user can log performance data for an exercise session without requiring permanent modifications to any given said external exercise equipment if said external exercise equipment is used.

11. The portable computerized system of claim 10 further including an integrated routine memory operably attached to said controller, which is able to store an exercise routine data signal representative of a component of a preprogrammed exercise routine and with which said controller will:

a) evaluate said sensing signals and produce said output signals which are modified or regulated by, said user input signals and said exercise routine data signals, whereby said user can be guided through a preprogrammed exercise routine which is dynamically regulated by said sensing signals.

12. The portable computerized system of claim 11 further including a speaker operably attached to said controller, for receiving audio output signals and with which said controller will:

a) evaluate said sensing signals and produce said audio output signals which are modified or regulated by, said user input signals and said exercise routine data signals, whereby audio cues comprised of said audio output signals are produced and dynamically regulated by said sensing signals.

13. The portable computerized system of claim 10 wherein said motion sensor is based upon electronic manipulation of ultrasonic sound waves.

14. The portable computerized system of claim 10 wherein said motion sensor is based upon electronic manipulation of light waves.

15. The portable computerized system of claim 10 wherein said motion sensor is based upon electronic manipulation of magnetic fields.

16. The portable computerized system of claim 10, further including an auto-centering circuit operably attached to lower-level and higher-level amplifier components of said motion sensor and said controller, whereby a low-level sensing signal representing ambient fields or waves prior to the active component of said motion sensor being engaged is subtracted from low-level sensing signals once said active component is engaged, and whereby factors which may affect sensor performance, comprised of temperature and ambient fields or waves are mitigated.

17. The portable computerized system of claim 10, further including an active component of said motion sensor that is to be placed on a moving object of interest for the duration of said exercise session, whereby an active agent to which said motion sensor is sensitive and selected from the group consisting of waves and fields, is produced.

18. The portable computerized system of claim 10, wherein said motion sensor has variable sensitivity by a potentiometer operably attached to an amplifier component of said motion sensor.

19. A sensing module designed to operably attach to a general-purpose portable computerized system or personal digital assistant comprising:

a) a sensing means for detecting parameters of exercise performance and for providing sensing signals representative thereof as input to said general-purpose portable computerized system and requiring at most a temporary attachment to any external exercise equipment, if any such said external exercise equipment is used, whereby said general-purpose portable computerized system can process said parameters of exercise performance for an exercise session, without requiring permanent modifications to any given said external exercise equipment if said external exercise equipment is used.

20. A method for using a general-purpose portable computerized system or personal digital assistant to log repetitive-motion data related to an exercise session, comprising the steps of:

a) detecting repetitions of motion of an object with a sensing means operably attached to said general-purpose portable computerized system which produces sensing signals representative thereof and requiring at most a temporary attachment to any external exercise equipment, if any such said external exercise equipment is used, whereby logging and the subsequent analysis of said performance data for most repetitive-motion exercises is facilitated without requiring permanent modifications to said external exercise equipment if any said external exercise equipment is used.

* * * * *